US012622486B2

(12) United States Patent
Masumoto et al.

(10) Patent No.: US 12,622,486 B2
(45) Date of Patent: May 12, 2026

(54) SOLE AND SHOE INCLUDING THE SOLE

(71) Applicant: ASICS CORPORATION, Kobe (JP)

(72) Inventors: Shingo Masumoto, Kobe (JP); Arthur Kilinkon, Kobe (JP)

(73) Assignee: ASICS CORPORATION, Kobe (JP)

( * ) Notice: Subject to any disclaimer, the term of this patent is extended or adjusted under 35 U.S.C. 154(b) by 0 days.

(21) Appl. No.: 18/623,372

(22) Filed: Apr. 1, 2024

(65) Prior Publication Data

US 2024/0341405 A1 Oct. 17, 2024

(30) Foreign Application Priority Data

Apr. 13, 2023 (JP) ..... 2023-065511

(51) Int. Cl.

| | |
|---|---|
| ***A43B 13/14*** | (2006.01) |
| ***A43B 7/1425*** | (2022.01) |
| ***A43B 13/18*** | (2006.01) |

(52) U.S. Cl.

CPC ..... *A43B 13/141* (2013.01); *A43B 7/1425* (2013.01); *A43B 13/145* (2013.01); *A43B 13/146* (2013.01); *A43B 13/187* (2013.01)

(58) Field of Classification Search

CPC ..... A43B 13/187; A43B 13/141; A43B 13/18; A43B 5/06; A43B 13/146; A43B 13/145; A43B 13/1425

(Continued)

(56) References Cited

U.S. PATENT DOCUMENTS 4,494,321 A * 1/1985 Lawlor ..... A43B 13/20 D2/956
6,237,256 B1 * 5/2001 Maki ..... A43B 7/145 36/176

(Continued)

FOREIGN PATENT DOCUMENTS

WO 2011/017174 A1 2/2011
WO 2019/073600 A1 4/2019

OTHER PUBLICATIONS

The extended European search report issued by the European Patent Office on May 16, 2024, which corresponds to European Patent Application No. 24166298.0-1015 and is related to U.S. Appl. No. 18/623,372.

(Continued)

*Primary Examiner* — Alissa L Hoey
*Assistant Examiner* — Akwokwo Olabisi Redhead
(74) *Attorney, Agent, or Firm* — Studebaker Brackett PLLC

(57) ABSTRACT

Provided are a sole capable of increasing a repulsive force supplementing a force with which a wearer moves their foot during a kick, and a shoe including the sole. The front foot portion includes a first-inner-foot-side-stepping portion that is a range A1 overlapping with a placement portion on which a foot of the wearer is placed and includes at least a part of a range A2 overlapping with the thenar portion of the wearer and a first-outer-foot-side-stepping portion that is the range A1 and includes at least a part of a range A3 overlapping with the hypothenar portion of the wearer when viewed in the top-bottom direction. The first-inner-foot-side-stepping portion is at least partially curved and projects in a downward direction, and is thicker than the first-outer-foot-side-stepping portion on an imaginary line L1 passing through the thenar portion and the hypothenar portion of the wearer.

16 Claims, 16 Drawing Sheets

(58) Field of Classification Search
USPC ..... 36/149, 28
See application file for complete search history.

(56) References Cited

U.S. PATENT DOCUMENTS

| | | | | |
|---|---|---|---|---|
| 6,544,626 | B1 * | 4/2003 | Minges | A43B 13/226 428/167 |
| 8,984,770 | B1 | 3/2015 | Piontkowski | |
| 2018/0084864 | A1 * | 3/2018 | Takada | A43B 7/1435 |
| 2018/0220737 | A1 * | 8/2018 | Piontkowski | A43B 17/023 |
| 2020/0297062 | A1 | 9/2020 | Sawada et al. | |
| 2020/0305545 | A1 | 10/2020 | Yahata et al. | |

OTHER PUBLICATIONS

Communication pursuant to Article 94(3) EPC issued by the European Patent Office on Jun. 23, 2025, which corresponds to European Patent Application No. 24 166 298.0-1015 and is related to U.S. Appl. No. 18/623,372.

* cited by examiner

SOLE AND SHOE INCLUDING THE SOLE

BACKGROUND

Cross-Reference to Related Applications

This application claims benefit of priority to Japanese Patent Application No. 2023-065511 filed Apr. 13, 2023, the entire contents of which are incorporated herein by reference.

TECHNICAL FIELD

The present teaching relates to soles and shoes including the soles.

BACKGROUND INFORMATION

Shoes used for sports such as running shoes are required not only to provide a wearer with a comfortable fit but also to support the wearer's movements such as running and stopping. Therefore, the soles of the shoes are enhanced in terms of shock absorption, repulsive force, grip, flexibility, and so forth through combinations of various materials and shapes. In shoes with such high functionalities, shoes that provide the wearer with a sense of lightness through enhanced grip and reduced weight are known (see Patent Document 1).

Patent Document 1 describes a shoe including a midsole and an outsole. The ground contact side of the midsole is covered with the outsole composed of an elastomer sheet. The outsole has a substantially flat ground contact surface in order to enhance grip and reduce the weight of the shoe. That is, the ground contact area of the outsole is larger than the ground contact area of the outsole having a complicated uneven shape. This enhances grip by the outsole to thereby provide the wearer with a sense of lightness

CITATION LIST

Patent Document

Patent Document 1: WO2019/073600

SUMMARY

The midsole and the outsole of the shoe described in Patent Document 1 have substantially the same thickness on an imaginary line passing through the thenar and the hypothenar of the wearer. That is, the midsole and the outsole of the shoe are shaped on the assumption that the midsole and the outsole of the shoe contacts the ground substantially uniformly. On the other hand, in the midsole and the outsole of the shoe, upon landing, pressure from the wearer concentrates on a portion overlapping with the thenar of the wearer during running (hereinafter referred to as an inner-foot-side-stepping portion"). Thus, in the shoe of Patent Document 1, in a portion supporting the thenar of the wearer, there have been cases where it is impossible to obtain a repulsive force supplementing a force with which the wearer moves their foot during a kick, in response to a pressure applied to the inner foot side stepping portion upon landing.

It is therefore an object of the present teaching to provide a sole capable of increasing a repulsive force supplementing a force with which a wearer moves their foot during a kick, and a shoe including the sole.

Inventors of the present teaching have studied a sole capable of increasing a repulsive force supplementing a force with which a wearer moves their foot during a kick in a portion supporting the thenar of the wearer, and a shoe including the sole. Through an intensive study, the inventors arrived at the following configuration.

A sole according to one embodiment of the present teaching is a sole for a shoe composed of an elastic body. The sole includes a front foot portion that is a range including at least a range from a front end to a thenar portion and a hypothenar portion of a wearer wearing the shoe. The front foot portion includes a first-inner-foot-side-stepping portion that is a range overlapping with a placement portion on which a foot of the wearer is placed, the first-inner-foot-side-stepping portion including at least a part of a range overlapping with the thenar portion of the wearer, when viewed in a top-bottom direction, and a first-outer-foot-side-stepping portion that is a range overlapping with the placement portion, the first-outer-foot-side-stepping portion including at least a part of a range overlapping with the hypothenar portion of the wearer, when viewed in the top-bottom direction. The first-inner-foot-side-stepping portion is at least partially curved and projects in a downward direction, and is thicker than the first-outer-foot-side-stepping portion on an imaginary line passing through the thenar portion and the hypothenar portion of the wearer.

One embodiment of the present teaching can increase a repulsive force supplementing a force with which a wearer moves their foot during a kick.

DETAILED DESCRIPTION

Figure 1:
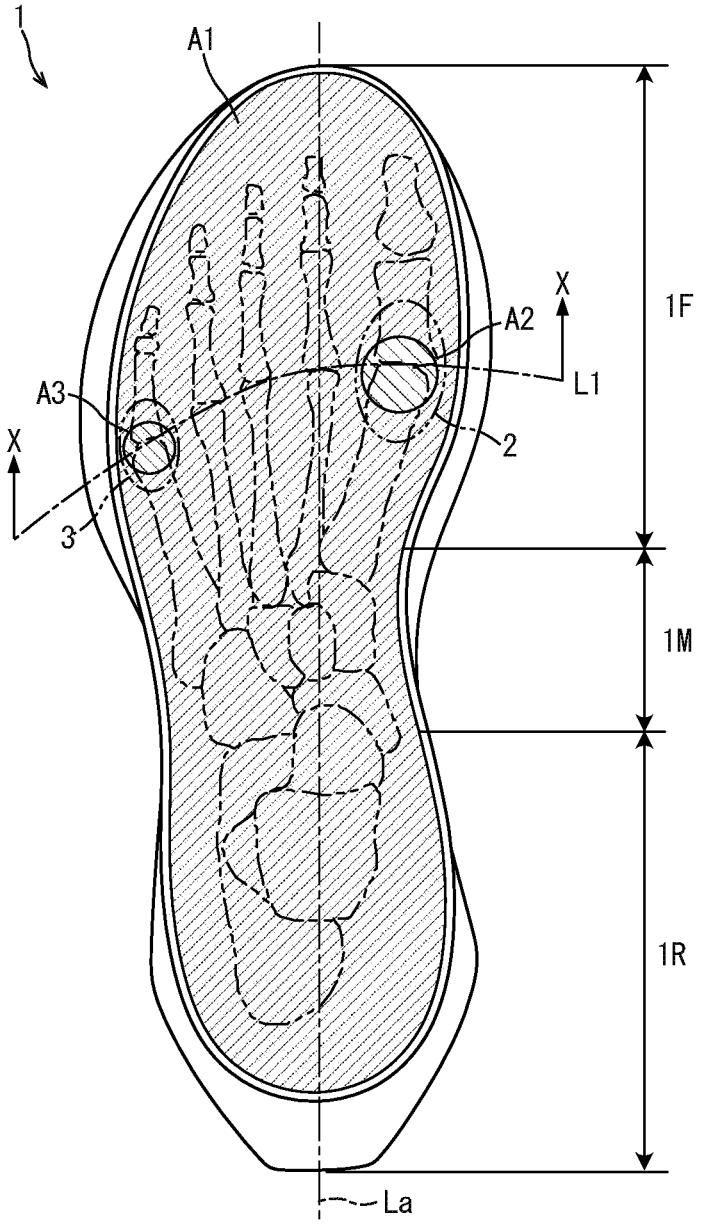
FIG. 1 is a plan view of a sole according to a first embodiment of the present teaching.

A sole according to an embodiment of the present teaching will now be specifically described. A sole according to the present teaching is not limited to those described in the embodiments below, and can be carried out with an appropriate change without departing from the gist of the teaching. In the embodiments and variations of the present teaching, like reference signs denote like or corresponding constituting elements and members, and the same description will be omitted as appropriate. Also, the dimensions of a member may be appropriately enlarged or reduced in each drawing in order to facilitate understanding. Further, in each drawing, part of a member less important in describing the embodiment may be omitted.

In the following description, for purposes of explanation, numerous specific details are set forth in order to provide a thorough understanding of the present teaching. It is obvious that those skilled in the art, however, would be able to carry out the present teaching without these specific examples.

The present disclosure is to be considered as an exemplification of the invention, and is not intended to limit the invention to the specific embodiments illustrated by the figures or description below.

Also, terms including ordinal numbers, such as first and second, are used to describe various constituting elements. Such terms are used in order to distinguish one constituting element from another and do not limit the constituting elements.

In the following description, expressions such as "fixed," "connected," "joined," and "attached" (hereinafter referred to as "fixed or the like") include not only a case where members are directly fixed or the like but also a case where the members are fixed or the like through other members. That is, in the following description, the expression such as "fixed or the like" includes meanings of directly and indirectly fixing or the like between members.

In the following description of soles and shoes according to embodiments and variations of the present teaching, the toe side of a wearer of the shoes is defined as a "front side," the heel side of the wearer is defined as a "rear side," the thumb side of the wearer is defined as an "inner foot side, and the little finger side of the wearer is defined as an "outer foot side." A direction from the heel toward the toe in the sole and the shoe is defined as a "forward direction," a direction from the toe toward the heel is defined as a "rearward direction," a direction from the sole toward the upper is defined as an "upward direction," a direction from the upper toward the sole is defined as a "downward direction," a direction orthogonal to the front-rear direction and the top-bottom direction and directed to the left when viewed in the forward direction is defined as a "leftward direction," and a direction orthogonal to the front-rear direction and the top-bottom direction and directed to the right when viewed in the forward direction is defined as a "rightward direction."

The front-rear direction of the sole and the shoe is defined as a "foot length direction," and the left-right direction of the sole and the shoe is defined as a "foot width direction." The length of the sole and the shoe in the front-rear direction is defined as a "foot length," and the length of the sole and the shoe in the left-right direction is defined as a "foot width." However, these definitions of directions are not intended to limit the orientation of the sole and the shoe in use.

First Embodiment

<Overall Configuration of Sole>

Figure 2:
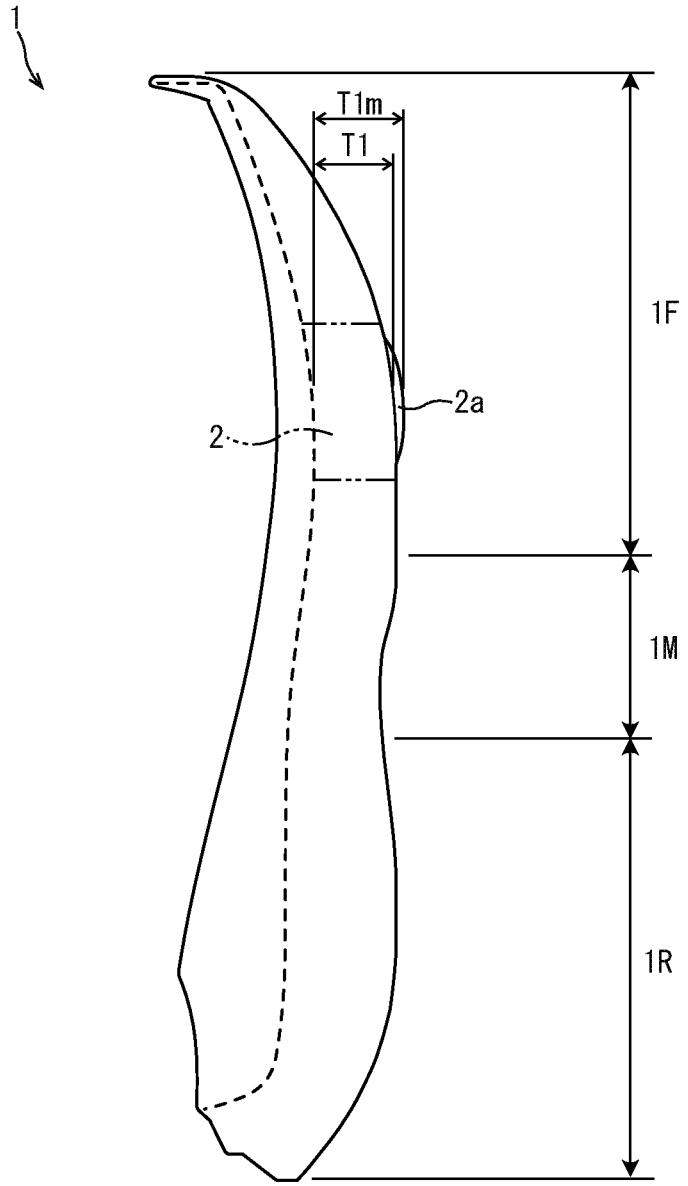
FIG. 2 is a side view of the sole according to the first embodiment of the present teaching.
Figure 3:
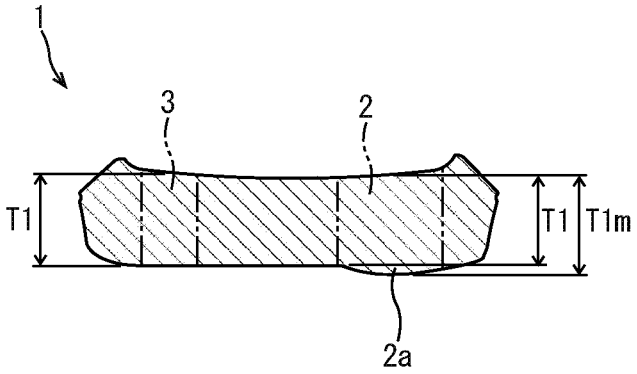
FIG. 3 is an X-X cross-sectional view in FIG. 1 illustrating the sole according to the first embodiment of the present teaching.
Figure 4:
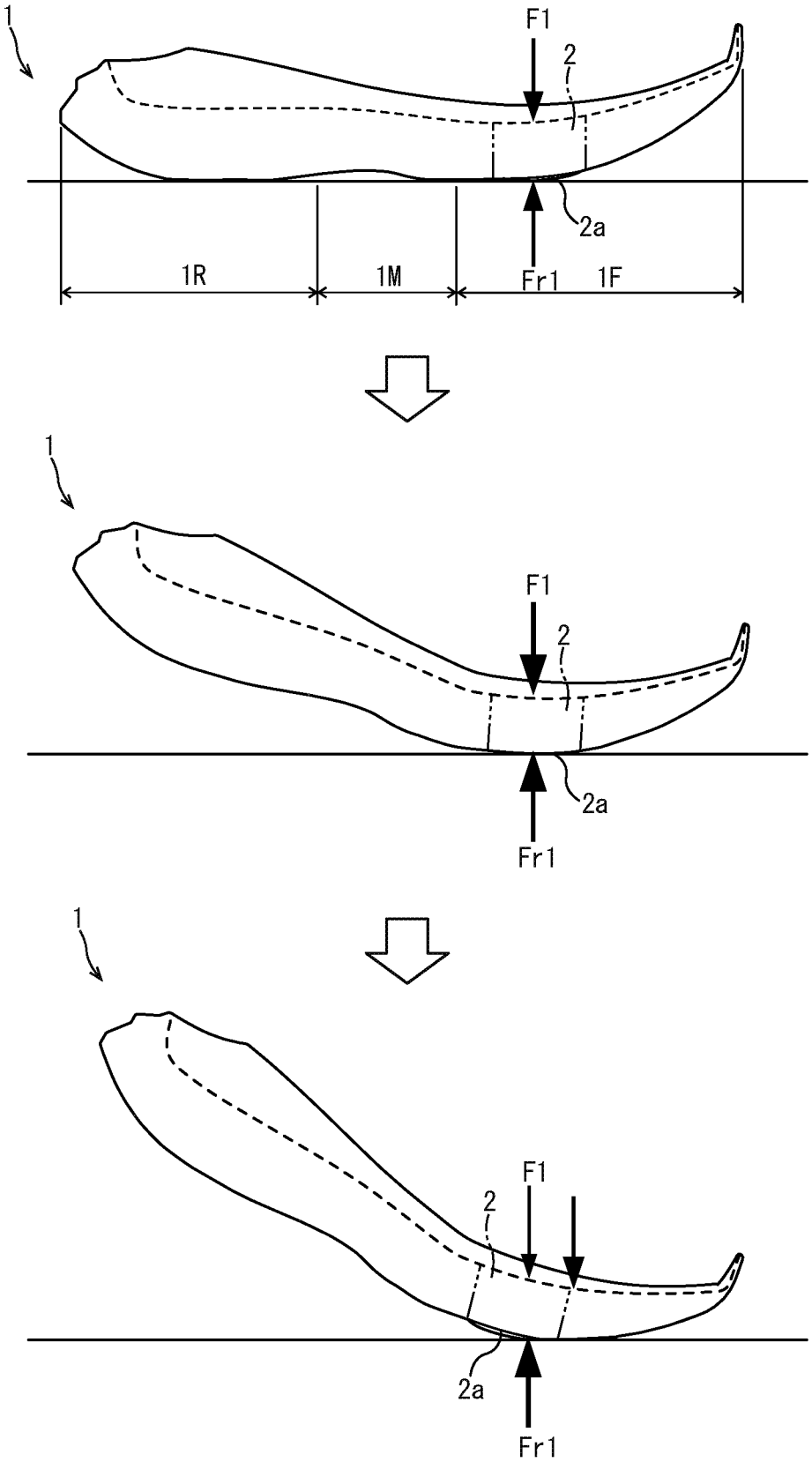
FIG. 4 shows schematic views illustrating a repulsive force of the sole according to the first embodiment of the present teaching while a wearer is walking or running in the forward direction.

With reference to FIGS. 1 through 4, a sole 1 according to a first embodiment of the present teaching will be hereinafter described. FIG. 1 is a plan view of the sole 1 according to the first embodiment of the present teaching. FIG. 2 is a side view of the sole 1. FIG. 3 is an X-X cross-sectional view in FIG. 1 illustrating the sole 1. FIG. 4 shows schematic views illustrating a repulsive force Fr1 of the sole 1 while a wearer is walking or running in the forward direction. The drawings used in the following embodiments and variations show a sole and a shoe for the left foot unless otherwise specified, but description is also similarly applicable to a sole and a shoe for the right foot.

The sole 1 is a portion supporting the foot of a wearer of a shoe including the sole 1 (hereinafter referred to simply as a "wearer"). The sole 1 is composed of a substantially plate-shaped elastic body with a given thickness. The sole 1 is located below the foot of the wearer in the shoe and located above the ground. That is, the sole 1 is located between the foot of the wearer and the ground. The upper surface of the sole 1 is located on the foot side of the wearer. The lower surface of the sole 1 is located on the ground side. The weight of the wearer and a pressure caused by landing are applied to the sole 1.

As illustrated in FIG. 1, in a range parallel to a straight line orthogonal to a center line La extending in the foot length direction, the sole 1 includes at least a front foot portion 1F that is a front region of the sole 1, and may include an intermediate foot portion 1M that is a substantially center region of the sole 1 and located rearward of the front foot portion 1F, and a rear foot portion 1R that is a rear region of the sole 1 and located rearward of the intermediate foot portion 1M. In the following embodiment, the sole 1 includes the front foot portion 1F, the intermediate foot portion 1M, and the rear foot portion 1R. The intermediate foot portion 1M and the rear foot portion 1R have known shapes, and thus, will not be described in detail. The front foot portion 1F includes at least a range from the front end of the sole 1 to a thenar portion near the base of the thumb of the wearer and to a hypothenar portion near the base of the little finger of the wearer. That is, when viewed in the top-bottom direction, the front foot portion 1F at least includes a range overlapping with the thenar portion and the hypothenar portion of the wearer. In the following embodiment, the front foot portion 1F is a region ranging up to about 45% of the foot length with reference to the front end of the sole 1, for example. The intermediate foot portion 1M is a region ranging from about 45% to about 60% of the foot length with reference to the front end of the sole 1, for example. The rear foot portion 1R is a region ranging from about 60% to 100% of the foot length with reference to the front end of the sole 1, for example.

The front foot portion 1F is a portion to which a force generated by a kick is applied when the wearer moves in the forward direction by walking. The front foot portion 1F includes a first-inner-foot-side-stepping portion 2 and a first-outer-foot-side-stepping portion 3.

The first-inner-foot-side-stepping portion 2 is a portion included in a range A1 (hatched portion) overlapping with a placement portion on which the foot of the wearer in an upright position is placed, and includes at least a part of a range A2 overlapping with the thenar portion of the wearer, when viewed in the top-bottom direction of the sole 1. That is, the first-inner-foot-side-stepping portion 2 includes at least a part of the range A2 in the range A1. In this embodiment, it is assumed that the first-inner-foot-side-stepping portion 2 includes the entire range A2. The first-inner-foot-side-stepping portion 2 is located on the inner foot side in a portion with the largest foot width in the front foot portion 1F. The placement portion on which the foot of the wearer is placed refers to a substantially flat portion of the upper surface of the sole 1 except for, for example, a rolled-up portion of the edge. The placement portion is a range to which a compressive force for compressing the sole 1 might be applied by the foot of the wearer. When viewed in the top-bottom direction, the placement portion includes a portion overlapping with the back surface of the foot of the wearer.

As illustrated in FIGS. 1 and 2, a first projection 2*a* projecting in the downward direction is located under the first-inner-foot-side-stepping portion 2. The first projection 2*a* projects such that at least a part of the lower surface of the first-inner-foot-side-stepping portion 2 is curved in the downward direction. The first projection 2*a* is located to overlap with the range A2, for example, when viewed in the top-bottom direction. The first projection 2*a* has a convex surface with a curved shape that is curved in the foot length direction and in the foot width direction. The convex surface declines toward an apex in the front-rear direction. Similarly, the convex surface declines toward the apex in the left-right direction. That is, in the first-inner-foot-side-stepping portion 2, the thickness from the upper surface to the lower surface of the front foot portion 1F (hereinafter referred to simply as a "thickness") increases toward the apex of the first projection 2*a*. Accordingly, as illustrated in FIGS. 2 and 3, a maximum thickness T1*m* of the first-inner-foot-side-stepping portion 2 is larger than a reference thickness T1 of a portion of the first-inner-foot-side-stepping portion 2 that does not project in the downward direction.

As illustrated in FIG. 1, when viewed in the top-bottom direction, the first-outer-foot-side-stepping portion 3 is a portion included in the range A1 overlapping with the placement portion and including at least a part of a range A3 overlapping with the hypothenar portion of the wearer. That is, the first-outer-foot-side-stepping portion 3 includes at least a part of the range A3 in the range A1. In this embodiment, it is assumed that the first-outer-foot-side-stepping portion 3 includes the entire range A3. The first-outer-foot-side-stepping portion 3 is located on the outer foot side of the sole 1 and rearward of the first-inner-foot-side-stepping portion 2. The lower surface of the first-outer-foot-side-stepping portion 3 does not project in the downward direction. Thus, the thickness of the first-outer-foot-side-stepping portion 3 is the reference thickness T1 (see FIGS. 2 and 3) that is the thickness of a portion that does not project in the downward direction.

In the front foot portion 1F, an imaginary line L1 extending along the metacarpophalangeal joints (MP joint, third joint) of the toes of the foot of the wearer passes through the range A2 that is the thenar portion of the wearer and the range A3 that is the hypothenar portion of the wearer. At this time, the imaginary line L1 passes through the first projection 2*a* including the range A2 and the first-outer-foot-side-stepping portion 3 including the range A3. Accordingly, on the imaginary line L1, the first-inner-foot-side-stepping portion 2 projects downward of the first-outer-foot-side-stepping portion 3 with respect to the upper surface of the front foot portion 1F. That is, the first-inner-foot-side-stepping portion 2 is thicker than the first-outer-foot-side-stepping portion 3 on the imaginary line L1.

<Advantages of First-Inner-Foot-Side-Stepping Portion 2>

Next, advantages of the first-inner-foot-side-stepping portion 2 will be described with reference to FIG. 4.

As illustrated in the upper section in FIG. 4, in a case where the wearer places the front foot portion 1F, the intermediate foot portion 1M, and the rear foot portion 1R on the ground in order to move forward during walking or running, the front foot portion 1F supports the foot of the wearer in the range A1 overlapping with the placement portion (see FIG. 1). In this case, a pressure is concentrated on, for example, the thenar portion, the distal phalanx portion of the thumb, and the heel of the foot of the wearer, in accordance with the posture of the foot. In the front foot portion 1F, a part of the pressure applied by the foot of the wearer is applied as a compressive force F1 that compresses the range A2 overlapping with the thenar portion of the wearer (see FIG. 2) when viewed in the top-bottom direction. The compressive force F1 applied to the range A2 by the thenar portion of the wearer is larger than an average of compressive forces applied to the range A1 of the front foot portion 1F by the foot of the wearer. Accordingly, the compressive force F1 larger than forces on the other portion other than the range A2 in the range A1 of the front foot portion 1F is applied to the first-inner-foot-side-stepping portion 2 including the range A1.

The first-inner-foot-side-stepping portion 2 is compressed in accordance with the magnitude of the compressive force F1 applied by the thenar portion of the wearer. In a case where the thickness of the front foot portion 1F in a compressed state is uniform in the entire front foot portion 1F, the compression amount of the first-inner-foot-side-stepping portion 2 (see FIG. 3) including the first projection 2*a* with the maximum thickness T1*m* larger than the reference thickness T1 is larger than the compression amount of the other portion in the front foot portion 1F described above. At this time, in the front foot portion 1F composed of the elastic body, a restoring force working to return to the original shape occurs in accordance with the compression amount. This restoring force is applied to the foot of the wearer as a repulsive force in the upward direction. In the first-inner-foot-side-stepping portion 2, a repulsive force Fr1 larger than a repulsive force generated in the other portion described above is generated, in accordance with the compression amount. Thus, the repulsive force Fr1 in the upward direction is applied to the thenar portion of the wearer by the first-inner-foot-side-stepping portion 2. As illustrated in the middle section in FIG. 4, in a case where the wearer lifts the heel using the imaginary line L1 corresponding to the MP joints of the foot (see FIG. 1) as a fulcrum in order to move forward during walking or running, the sole 1 is bent such that the intermediate foot portion 1M and the rear foot portion 1R move in the upward direction using a portion near the imaginary line L1 including the thenar portion of the wearer as a bent position, in accordance with bending of the MP joints of the foot of the wearer. In this case, the compressive force F1 applied to the range A2 increases by concentration of positions supporting the foot of the wearer near the imaginary line L1. The first-inner-foot-side-stepping portion 2 is further compressed in accordance with the compressive force F1 applied by the thenar portion of the wearer. Thus, in the first-inner-foot-side-stepping portion 2, the repulsive force Fr1 increases in accordance with the compression amount.

As illustrated in the lower section in FIG. 4, in a case where the wearer moves the barycenter in the forward direction in order to move forward during walking or running, a part of the compressive force F1 applied to the first-inner-foot-side-stepping portion 2 by the thenar portion of the wearer is applied to the distal phalanx portion of the thumb of the wearer. The compressive force F1 applied to the first-inner-foot-side-stepping portion 2 by the thenar portion of the wearer becomes smaller than the repulsive force Fr1 (see the middle section in FIG. 4) applied to the thenar portion of the wearer by the first-inner-foot-side-stepping portion 2 before the wearer moves the barycenter in the forward direction. Thus, the first-inner-foot-side-stepping portion 2 pushes the thenar portion of the wearer in the upward direction with the repulsive force Fr1. Accordingly, while the wearer moves the barycenter in the forward direction, the first-inner-foot-side-stepping portion 2 assists movement of the thenar portion by the wearer with the repulsive force Fr1.

In a case where the wearer lifts the thenar portion using the distal phalanx portion of the thumb as a fulcrum in order to move forward during walking or running, the compressive force F1 applied to the first-inner-foot-side-stepping portion 2 by the thenar portion of the wearer decreases with upward movement of the thenar portion of the wearer. Similarly, the compression amount of the first-inner-foot-side-stepping portion 2 decreases with upward movement of the thenar portion of the wearer. The first-inner-foot-side-stepping portion 2 is restored to the shape before compression in conformity with upward movement of the thenar portion while applying the upward repulsive force Fr1 to the thenar portion of the wearer.

The thus-configured first-inner-foot-side-stepping portion 2 of the sole 1 includes the first projection 2*a* curved and projecting in the downward direction. The first projection 2*a* is thicker than the other portion of the front foot portion 1F other than the first projection 2*a*. Thus, in a case where the thickness in the state of being compressed with the compressive force F1 from the foot of the wearer is uniform in the entire front foot portion 1F, the first projection 2*a* generates the repulsive force Fr1 larger than those in the other portion described above.

In addition, the first projection 2*a* is configured to have one convex surface that is curved in the foot length direction and in the foot width direction. Thus, since the first projection 2*a* is not surrounded by any other members, deformation in the foot length direction and in the foot width direction due to compression with the compressive force F1 from the foot of the wearer is not easily hindered. Furthermore, since the first projection 2*a* is curved, even when the posture and the shape of the sole 1 change by bending of the foot of the wearer, the posture to the ground is stabilized, and the barycenter is smoothly moved by the wearer in the forward direction. Accordingly, the repulsive force Fr1 supplementing a force with which the wearer moves their foot during a kick can be increased in the thenar portion.

Variations

Variations of the first embodiment will now be described. In the drawings and description of the variations, like reference characters denote like or corresponding constituting elements and members in the embodiment. Repetitive description already provided in the embodiment will be omitted as appropriate, and configurations different from those in the embodiment will be described in detail.

First Variation

Figure 5:
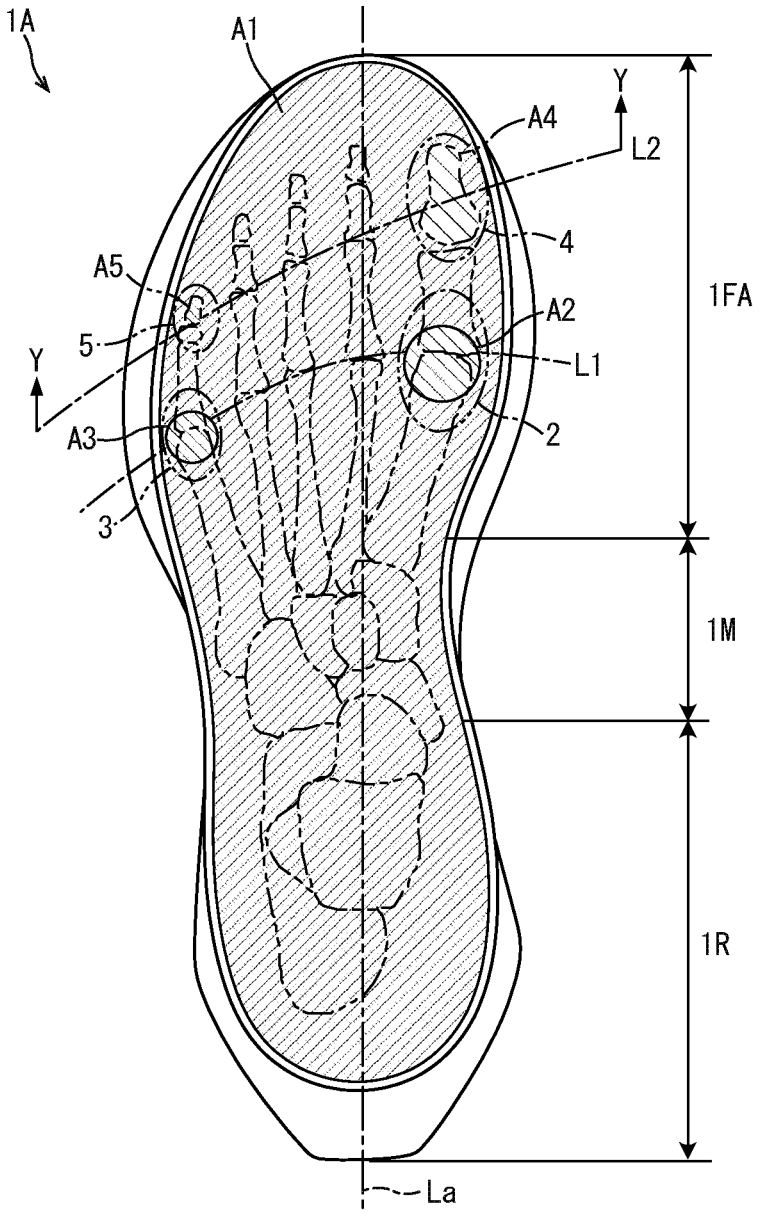
FIG. 5 is a plan view of a sole according to a first variation of the first embodiment of the present teaching.
Figure 6:
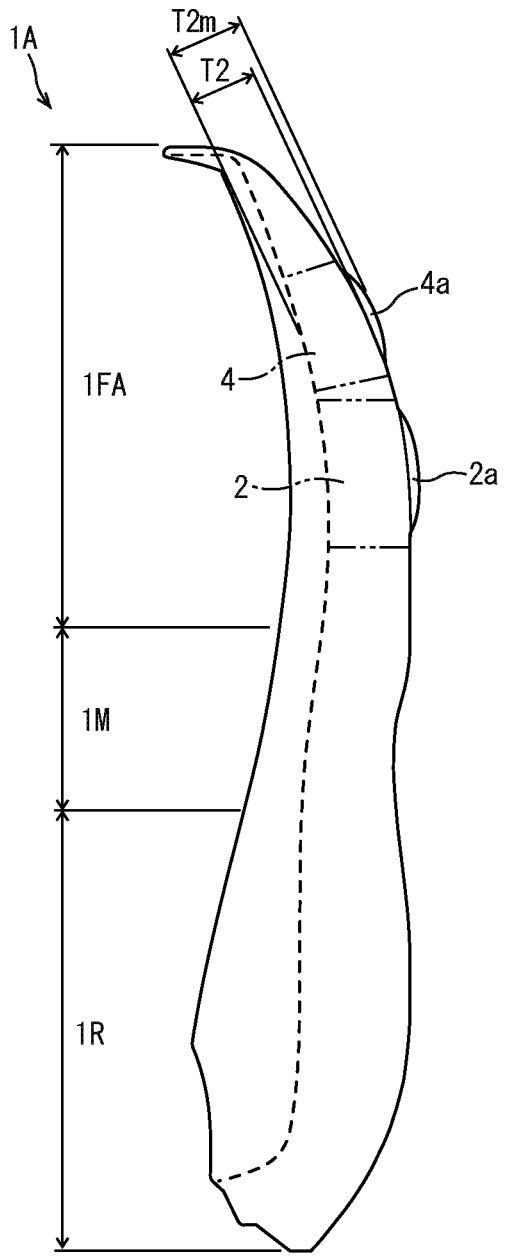
FIG. 6 is a side view of the sole according to the first variation of the first embodiment of the present teaching.
Figure 7:
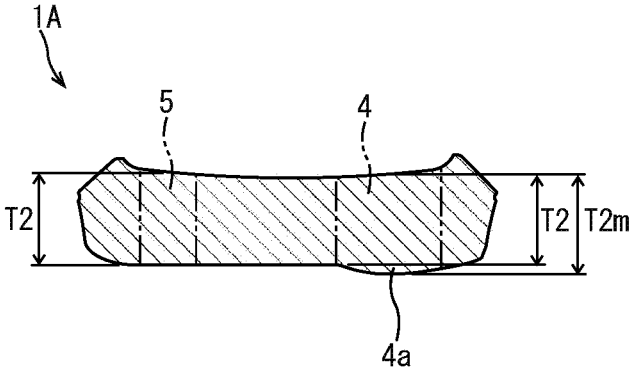
FIG. 7 is a Y-Y cross-sectional view in FIG. 5.
Figure 8:
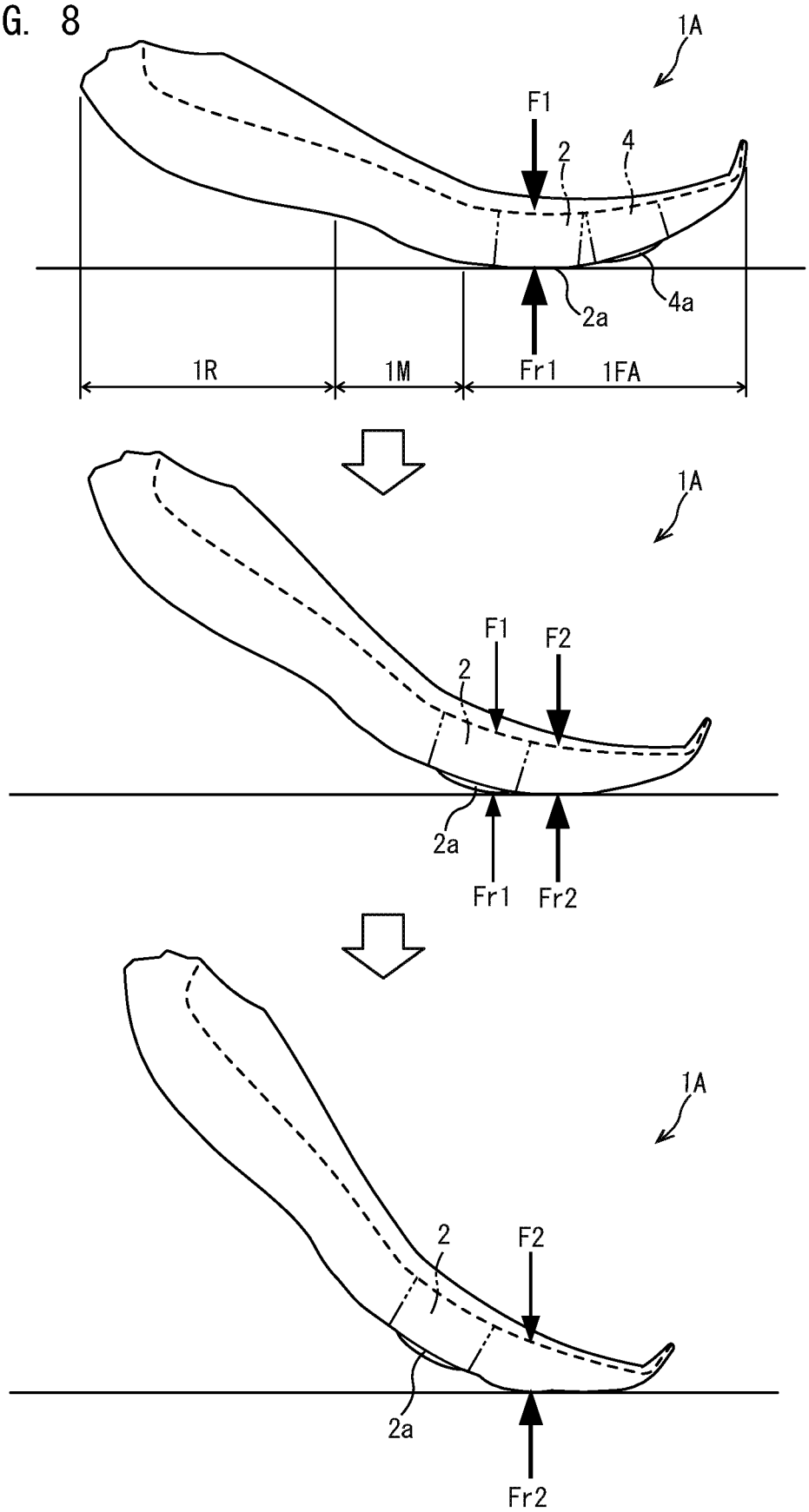
FIG. 8 shows schematic views illustrating a repulsive force of the sole according to the first variation of the first embodiment of the present teaching while a wearer is walking or running in the forward direction.

With reference to FIGS. 5 through 8, a sole 1A according to a first variation will be described. FIG. 5 is a plan view of the sole 1A according to the first variation of the first embodiment of the present teaching. FIG. 6 is a side view of the sole 1A. FIG. 7 is a Y-Y cross-sectional view in FIG. 5. FIG. 8 shows schematic views illustrating the sole 1A showing a repulsive force Fr2 of the sole 1A while the wearer is walking or running in the forward direction. The first variation is different from the first embodiment in further including a second-inner-foot-side-stepping portion 4 and a second-outer-foot-side-stepping portion 5.

As illustrated in FIG. 5, a front foot portion 1FA of the sole 1A includes a first-inner-foot-side-stepping portion 2, a first-outer-foot-side-stepping portion 3, the second-inner-foot-side-stepping portion 4, and the second-outer-foot-side-stepping portion 5.

The second-inner-foot-side-stepping portion 4 is a portion included in the range A1 and including at least a part of a range A4 overlapping with the distal phalanx portion of the thumb of the wearer, when viewed in the top-bottom direction. That is, the second-inner-foot-side-stepping portion 4 includes at least a part of the range A4 in the range A1. In this embodiment, it is assumed that the second-inner-foot-side-stepping portion 4 includes the entire range A4. The second-inner-foot-side-stepping portion 4 is located forward of the first-inner-foot-side-stepping portion 2 in the front foot portion 1FA.

As illustrated in FIG. 6, a second projection 4*a* projecting in the downward direction is located on the lower surface of the second-inner-foot-side-stepping portion 4. The second projection 4*a* projects such that at least a part of the lower surface of the second-inner-foot-side-stepping portion 4 is curved in the downward direction. The second projection 4*a* is located in the range A4 (see FIG. 5), for example. The second projection 4*a* has a convex surface with a curved shape that is curved in the foot length direction and in the foot width direction. The convex surface declines toward an apex in the front-rear direction. Similarly, the convex surface declines toward the apex in the left-right direction. That is, the thickness of the second-inner-foot-side-stepping portion 4 increases toward the apex of the second projection 4*a* on the lower surface. Accordingly, as illustrated in FIGS. 6 and 7, a maximum thickness T2*m* of the second-inner-foot-side-stepping portion 4 including the second projection 4*a* is larger than a reference thickness T2 of a portion of the second-inner-foot-side-stepping portion 4 that does not project in the downward direction.

As illustrated in FIGS. 5 through 7, the second-outer-foot-side-stepping portion 5 is a portion included in the range A1 and including at least a part of a range A5 overlapping with the distal phalanx of the little finger of the wearer, when viewed in the top-bottom direction. That is, the first-outer-foot-side-stepping portion 5 includes at least a part of the range A5 in the range A1. In this embodiment, it is assumed that the second-outer-foot-side-stepping portion 5 includes the entire range A5. The second-outer-foot-side-stepping portion 5 is located forward of the first-outer-foot-side-stepping portion 3. The lower surface of the second-outer-foot-side-stepping portion 5 does not project in the downward direction. Thus, the thickness of the second-outer-foot-side-stepping portion 5 is the reference thickness T2 that is a thickness of a portion that does not project in the downward direction.

As illustrated in FIG. 5, in the front foot portion 1FA, an imaginary line L2 passing through the distal phalanx portion of the thumb and the distal phalanx of the little finger passes through the second-inner-foot-side-stepping portion 4 and the second-outer-foot-side-stepping portion 5. Accordingly, on the imaginary line L2, the second-inner-foot-side-stepping portion 4 projects downward of the second-outer-foot-side-stepping portion 5 with respect to the upper surface of the front foot portion 1FA. That is, the second-inner-foot-side-stepping portion 4 is thicker than the second-outer-foot-side-stepping portion 5 on the imaginary line L2.

<Advantages of First-Inner-Foot-Side-Stepping Portion 2 and Second-Inner-Foot-Side-Stepping Portion 4>

Next, with reference to FIG. 8, advantages of the first-inner-foot-side-stepping portion 2 and the second-inner-foot-side-stepping portion 4 will be described.

In a case where the wearer places the front foot portion 1FA, the intermediate foot portion 1M, and the rear foot portion 1R on the ground in order to move forward during walking or running, in the front foot portion 1FA, a part of a compressive force applied by the foot of the wearer is concentrated on the range A2 (see FIG. 5) overlapping with the thenar portion of the wearer and the range A4 (see FIG. 5) overlapping with the distal phalanx portion of the thumb of the wearer, when viewed in the top-bottom direction. Each of the compressive force F1 applied to the range A2 by the thenar portion of the wearer and the compressive force F2 applied to the range A4 by the distal phalanx portion of the thumb of the wearer is larger than an average of compressive forces applied to the range A1 of the front foot portion 1FA by the foot of the wearer. Accordingly, the compressive forces F1 and F2 larger than those on the other portion other than the range A2 and the range A4 in the range A1 of the front foot portion 1FA are applied to the first-inner-foot-side-stepping portion 2 including the range A1 and the second-inner-foot-side-stepping portion 4 including the range A4.

As illustrated in the upper section in FIG. 8, in a case where the wearer lifts the heel using the MP joints of the foot as a fulcrum in order to move forward by walking or running, the sole 1A is bent such that the intermediate foot portion 1M and the rear foot portion 1R move in the upward direction using a portion near the imaginary line L1 (see FIG. 5) including the thenar portion of the wearer as a bent position, in accordance with bending of the MP joints of the foot of the wearer. The first-inner-foot-side-stepping portion 2 is further compressed in accordance with the compressive force F1 applied by the thenar portion of the wearer. Thus, in the first-inner-foot-side-stepping portion 2, the repulsive force Fr1 increases in accordance with the compression amount.

As illustrated in the middle section in FIG. 8, in a case where the wearer moves the barycenter in the forward direction in order to move forward by walking, positions supporting the foot of the wearer are concentrated near the imaginary line L1 and in the distal phalanx portion of the thumb of the wearer (see FIG. 5). In this case, the compressive force F2 applied to the range A4 further increases. The second-inner-foot-side-stepping portion 4 is compressed more greatly than the other portion in the front foot portion 1FA described above, in accordance with the compressive force F2 applied by the distal phalanx portion of the thumb of the wearer. At this time, in the second-inner-foot-side-stepping portion 4, the repulsive force Fr2 larger than the repulsive forces occurring in the other portion in the front foot portion 1FA described above is generated in accordance with the compression amount. Thus, the repulsive force Fr1 in the upward direction is applied to the thenar portion of the wearer by the first-inner-foot-side-stepping portion 2. In addition, the upward repulsive force Fr2 is applied to the distal phalanx portion of the thumb of the wearer by the second-inner-foot-side-stepping portion 4.

As illustrated in the lower section in FIG. 8, in a case where the wearer moves the barycenter located on one foot to the other foot in order to move forward by walking, the wearer further moves the heel in the upward direction. In this case, the thenar portion of the wearer is lifted in the upward direction. The compressive force F2 applied to the second-inner-foot-side-stepping portion 4 by the distal phalanx portion of the thumb of the wearer becomes smaller than the repulsive force Fr2 applied to the distal phalanx portion of the thumb of the wearer by the second-inner-foot-side-stepping portion 4. Thus, the second-inner-foot-side-stepping portion 4 pushes the distal phalanx portion of the thumb of the wearer in the upward direction with the repulsive force Fr2. Accordingly, while the wearer moves the barycenter to the other foot, the second-inner-foot-side-stepping portion 4 assists movement of the distal phalanx portion of the thumb by the wearer with the repulsive force Fr2.

The thus-configured second-inner-foot-side-stepping portion 4 of the sole 1A includes the second projection 4*a* curved and projecting in the downward direction. The second projection 4*a* is thicker than the other portion of the front foot portion 1FA other than the first projection 2*a* and the second projection 4*a*. Thus, in a case where the thickness in the state of being compressed with the compressive force F2 from the foot of the wearer is uniform in the entire front foot portion 1FA, the second projection 4*a* generates the repulsive force Fr2 larger than those in the other portion described above. Accordingly, when the wearer moves forward during walking or running, the sole 1A assists movement of the thenar portion of the wearer with the repulsive force Fr1 of the first-inner-foot-side-stepping portion 2 and assists movement of the distal phalanx portion of the thumb of the wearer with the repulsive force Fr2 of the second-inner-foot-side-stepping portion 4.

In addition, the second projection 4*a* is configured to have one convex surface that is curved in the foot length direction and in the foot width direction. Thus, since the second projection 4*a* is not surrounded by any other members, deformation in the foot length direction and in the foot width direction due to compression with the compressive force F2 from the foot of the wearer is not easily hindered. Furthermore, since the second projection 4*a* is curved, even when the posture and the shape of the sole 1A change by bending of the foot of the wearer, the posture to the ground is stabilized, and the barycenter is smoothly moved by the wearer in the forward direction. Accordingly, the repulsive force Fr2 supplementing a force with which the wearer moves their foot during a kick can be increased in the thenar portion and the distal phalanx portion of the thumb.

Second Variation

Figure 9:
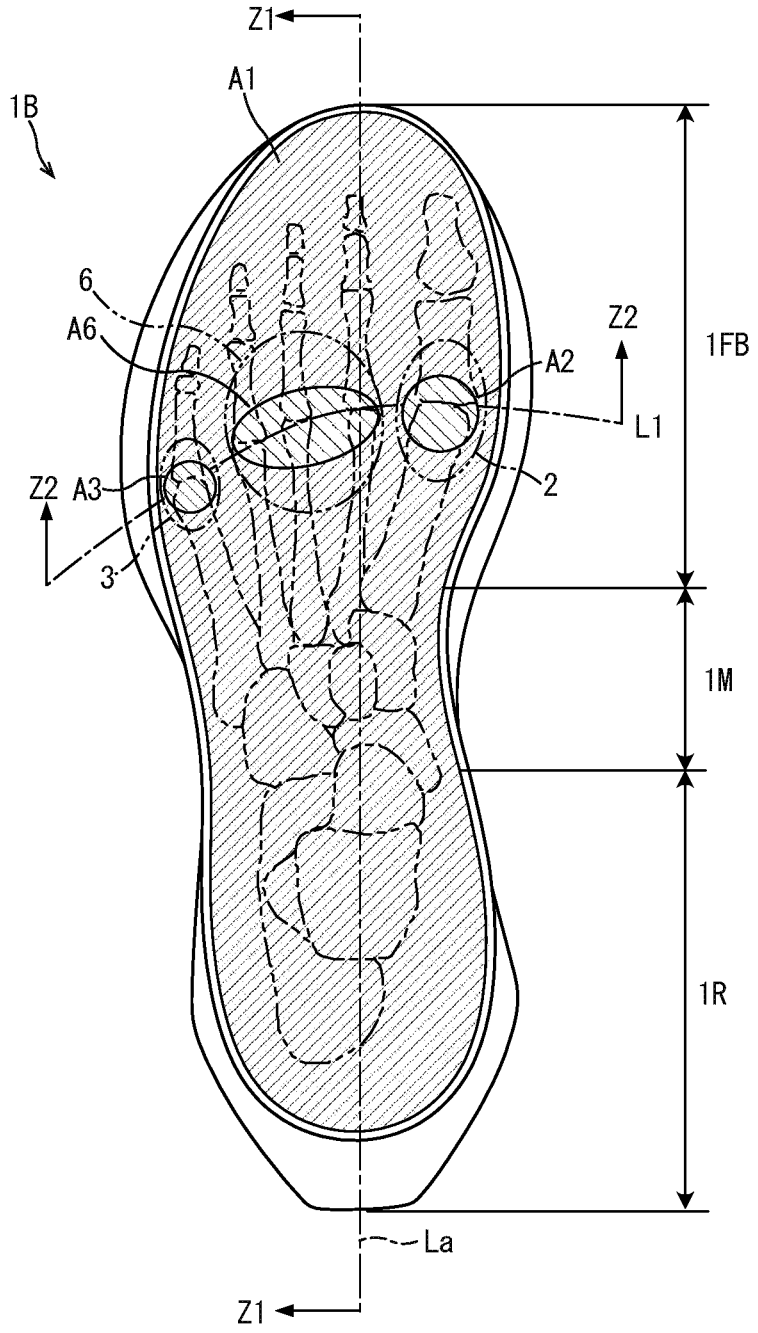
FIG. 9 is a plan view of a sole according to a second variation of the first embodiment of the present teaching.
Figure 10:
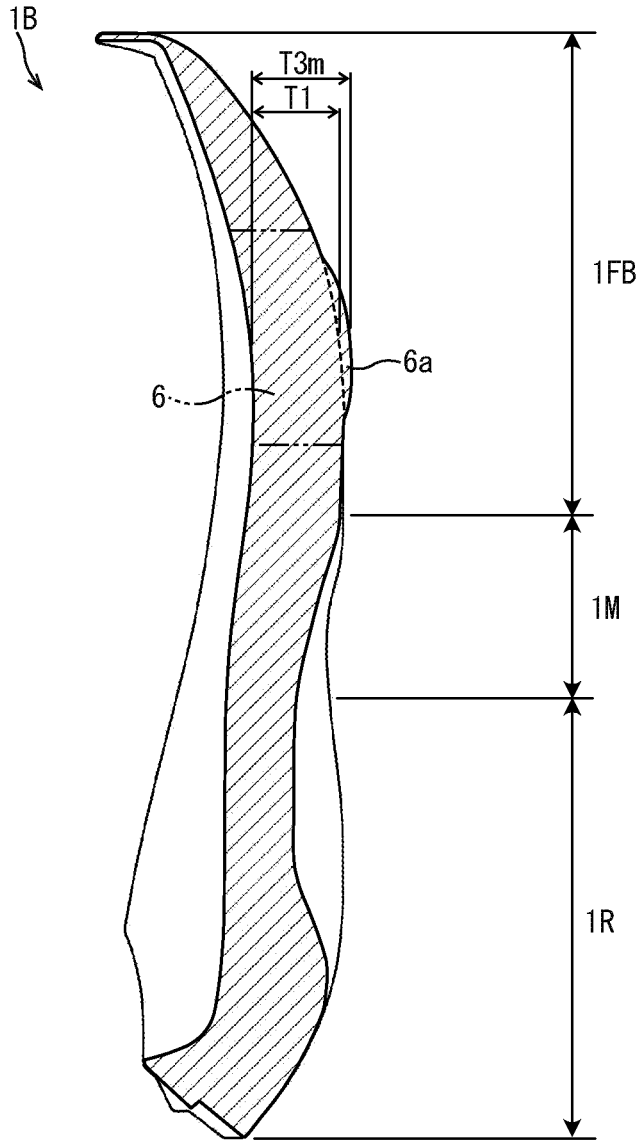
FIG. 10 is a Z1-Z1 cross-sectional view in FIG. 9.
Figure 11:
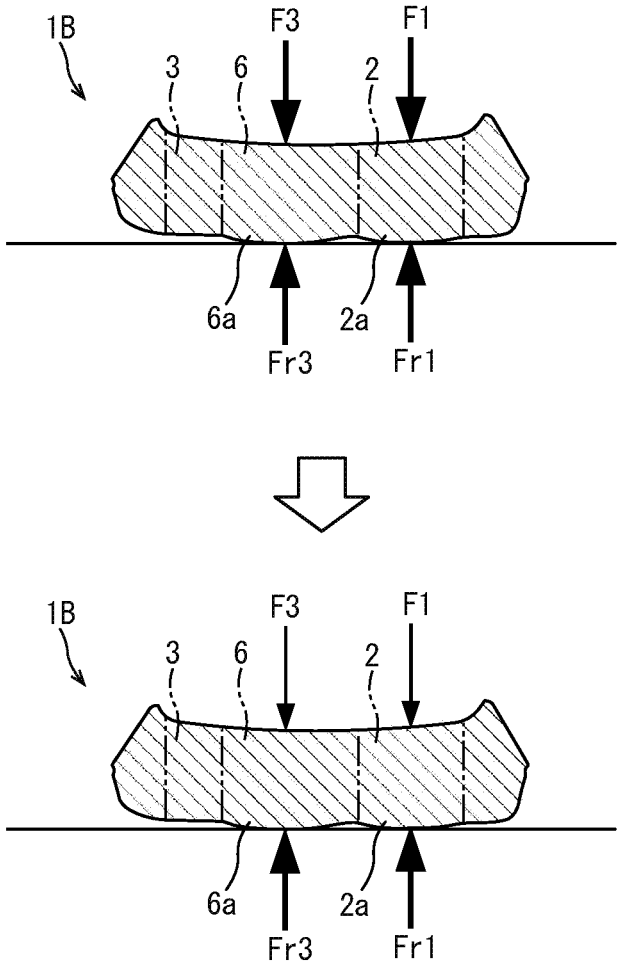
FIG. 11 shows schematic views illustrating a repulsive force of the sole while the wearer is walking or running in the forward direction in the Z2-Z2 cross-sectional view in FIG. 9.

With reference to FIGS. 9 through 11, a sole 1B according to a second variation will be described. FIG. 9 is a plan view of the sole 1B according to the second variation of the first embodiment of the present teaching. FIG. 10 is a Z1-Z1 cross-sectional view in FIG. 9. FIG. 11 shows schematic views illustrating a repulsive force of the sole 1B while the wearer is walking or running in the forward direction in the Z2-Z2 cross-sectional view in FIG. 9. The second variation is different from the first embodiment in further including a center stepping portion 6.

As illustrated in FIG. 9, the front foot portion 1FB of the sole 1B includes a first-inner-foot-side-stepping portion 2, a first-outer-foot-side-stepping portion 3, and the center stepping portion 6.

The center stepping portion 6 is a portion included in the range A1 and including at least a part of a range A6 overlapping with MP joints of the second toe, the third toe, and the fourth toe of the wearer, when viewed in the top-bottom direction. That is, the center stepping portion 6 includes at least a part of the range A6 in the range A1. In this embodiment, it is assumed that the center stepping portion 6 includes the entire range A6. The center stepping portion 6 is located on the outer foot side of the first-inner-foot-side-stepping portion 2 and on the inner foot side of the first-outer-foot-side-stepping portion 3 in the front foot portion 1FB. That is, the center stepping portion 6 is located between the first-inner-foot-side-stepping portion 2 and the first-outer-foot-side-stepping portion 3. The center stepping portion 6 is a range extending in the front-rear direction from the MP joints of the second toe, the third toe, and the fourth toe.

As illustrated in FIGS. 10 and 11, a center projection 6*a* projecting in the downward direction is located on the lower surface of the center stepping portion 6. The center projection 6*a* projects such that at least a part of the lower surface of the center stepping portion 6 is curved in the downward direction. The center projection 6*a* is located in the range A6, for example. The center projection 6*a* has a convex surface with a curved shape that is curved in the foot length direction and in the foot width direction. The convex surface declines toward an apex in the front-rear direction with respect to the upper surface of the center stepping portion 6. Similarly, the convex surface declines toward the apex in the left-right direction with respect to the upper surface of the center stepping portion 6. That is, the thickness of the center stepping portion 6 increases toward the apex of the center projection 6*a* on the lower surface. Accordingly, a maximum thickness T3*m* of the center stepping portion 6 including the center projection 6*a* is larger than the reference thickness T1 of the first-outer-foot-side-stepping portion 3.

As illustrated in FIG. 9, in the front foot portion 1FB, the imaginary line L1 passes through the distal phalanx portion of the thumb, the MP joints of the second toe, the third toe, and the fourth toe of the wearer, and the distal phalanx of the little finger. The imaginary line L1 also passes through the first projection 2*a* of the first-inner-foot-side-stepping portion 2, the center projection 6*a* of the center stepping portion 6, and the first-outer-foot-side-stepping portion 3. Accordingly, on the imaginary line L1, the center stepping portion 6 projects downward of the first-outer-foot-side-stepping portion 3. That is, the center stepping portion 6 is thicker than the first-outer-foot-side-stepping portion 3 on the imaginary line L1.

<Advantages of First-Inner-Foot-Side-Stepping Portion 2 and Center Stepping Portion 6>

Next, with reference to FIG. 11, advantages of the first-inner-foot-side-stepping portion 2 and the center stepping portion 6 will be described.

In a case where the wearer places the front foot portion 1FB, the intermediate foot portion 1M, and the rear foot portion 1R on the ground in order to move forward during walking or running, in the front foot portion 1FB (see FIG. 9), a part of a compressive force applied by the foot of the wearer is concentrated on the range A2 (see FIG. 9) overlapping with the thenar portion of the wearer and the range A6 (see FIG. 9) overlapping with the MP joints of the second toe, the third toe, and the fourth toe the wearer. Each of the compressive force F1 applied to the range A2 by the thenar portion of the wearer and the compressive force F3 applied to the range A6 by the MP joints of the second toe, the third toe, and the fourth toe of the wearer are larger than an average of compressive forces applied to the range A1 of the front foot portion 1FB by the foot of the wearer. Accordingly, the compressive forces F1 and F3 larger than those on the other portion other than the range A2 and the range A6 in the range A1 of the front foot portion 1FB are applied to the first-inner-foot-side-stepping portion 2 including the range A1 and the center foot stepping portion 6 including the range A6.

As illustrated in the upper section in FIG. 11, in the center stepping portion 6, the compressive force F3 is applied to the range A6 by the MP joints of the second toe, the third toe, and the fourth toe of the wearer. The center stepping portion 6 is compressed in accordance with the magnitude of the compressive force F2 applied by the MP joints of the second toe, the third toe, and the fourth toe of the wearer. The compression amount of the center stepping portion 6 is larger than the other portion in the front foot portion 1FB described above. At this time, in the center foot stepping portion 6, the repulsive force Fr3 larger than repulsive forces occurring in the other portion in the front foot portion 1FB described above is generated in accordance with the compression amount. Thus, the upward repulsive force Fr3 is applied to the MP joints of the second toe, the third toe, and the fourth toe of the wearer by the center stepping portion 6. The repulsive force Fr1 in the upward direction is applied to the thenar portion of the wearer by the first-inner-foot-side-stepping portion 2.

In a case where the wearer moves the barycenter in the forward direction in order to move forward by walking, a part of the compressive force F3 applied to the center stepping portion 6 by the MP joints of the second toe, the third toe, and the fourth toe of the wearer is applied to the distal phalanx portion of the thumb of the wearer. The compressive force F3 applied to the center stepping portion 6 by the MP joints of the second toe, the third toe, and the fourth toe of the wearer becomes smaller than the repulsive force Fr3 applied to the MP joints of the second toe, the third toe, and the fourth toe of the wearer by the center stepping portion 6 (see the lower section in FIG. 11). Thus, the center stepping portion 6 pushes the MP joints of the second toe, the third toe, and the fourth toe of the wearer in the upward direction with the repulsive force Fr3. The first-inner-foot-side-stepping portion 2 pushes the thenar portion of the wearer in the upward direction with the repulsive force Fr1. Accordingly, when the wearer moves the barycenter in the forward direction, the center stepping portion 6 assists movement of the MP joints of the second toe, the third toe, and the fourth toe by the wearer with the repulsive force Fr3 together with the repulsive force Fr1 of the first-inner-foot-side-stepping portion 2.

The thus-configured center stepping portion 6 of the sole 1B includes the center projection 6*a* curved and projecting in the downward direction. The center projection 6*a* is thicker than the other portion other than the first projection 2*a* and the center projection 6*a* in the front foot portion 1FB. Thus, in a case where the thickness in the state of being compressed with the compressive force F3 from the foot of the wearer is uniform in the entire front foot portion 1FB, the center projection 6*a* generates the repulsive force Fr3 larger than those in the other portion described above. Accordingly, when the wearer moves forward during walking or running, the sole 1B assists movement of the thenar portion of the wearer with the repulsive force Fr1 of the first-inner-foot-side-stepping portion 2 and assists movement of the MP joints of the second toe, the third toe, and the fourth toe of the wearer with the repulsive force Fr3 of the center foot stepping portion 6.

The center projection 6*a* is configured to have one convex surface curved in the foot length direction and in the foot width direction. Thus, since the center projection 6*a* is not surrounded by any other members, deformation in the foot length direction and in the foot width direction due to compression with the compressive force F3 from the foot of the wearer is not easily hindered. Furthermore, since the shape of the center projection 6*a* extending in the front-rear direction is curved, even when the posture and the shape of the sole 1B change by bending of the foot of the wearer and movement of the barycenter, the posture to the ground is stabilized, and the barycenter is smoothly moved by the wearer in the forward direction. Accordingly, the first-inner-foot-side-stepping portion 2 and the center stepping portion 6 can increase a repulsive force supplementing a force with which the wearer moves their foot during a kick in the MP joints.

Third Variation

Figure 12:
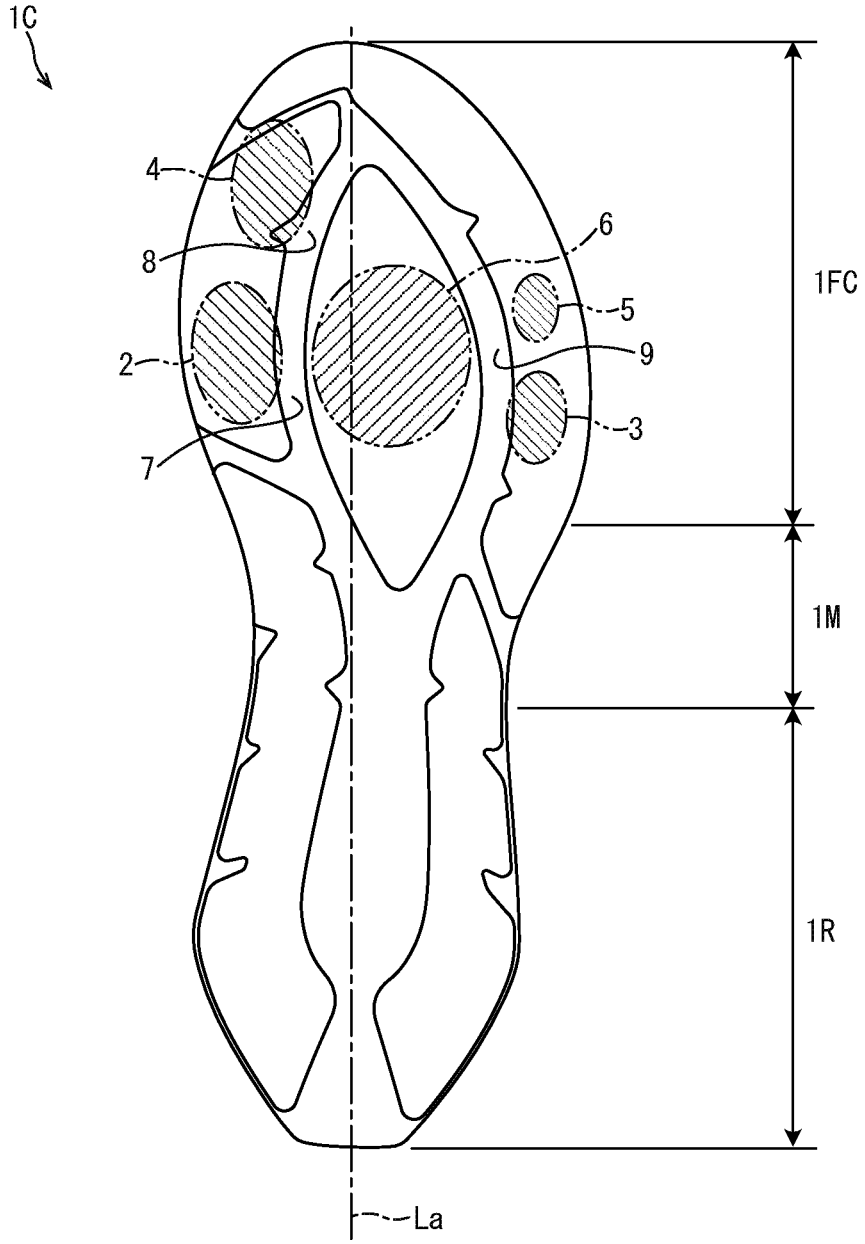
FIG. 12 is a bottom view of a sole according to a third variation of the first embodiment of the present teaching.

With reference to FIG. 12, a sole 1C according to a third variation will be described. FIG. 12 is a bottom view of the sole 1C according to the third variation of the first embodiment of the present teaching. The third variation is different from the first embodiment in further including a second-inner-foot-side-stepping portion 4, a second-outer-foot-side-stepping portion 5, a center stepping portion 6, a first groove 7, a second groove 8, and a third groove 9.

As illustrated in FIG. 12, a front foot portion 1FC of the sole 1C includes the first-inner-foot-side-stepping portion 2, the first-outer-foot-side-stepping portion 3, the second-inner-foot-side-stepping portion 4, the second-outer-foot-side-stepping portion 5, the center stepping portion 6, the first groove 7, the second groove 8, and the third groove 9.

The second-inner-foot-side-stepping portion 4 is located forward of the first-inner-foot-side-stepping portion 2 in the front foot portion 1FC. The second-outer-foot-side-stepping portion 5 is located forward of the first-outer-foot-side-stepping portion 3. In the front foot portion 1FC, the center stepping portion 6 is located on the outer foot side of the first-inner-foot-side-stepping portion 2 and the second-inner-foot-side-stepping portion 4 and on the inner foot side of the first-outer-foot-side-stepping portion 3 and the second-outer-foot-side-stepping portion 5. That is, in the front foot portion 1FC, when viewed in the top-bottom direction, the first-inner-foot-side-stepping portion 2 and the second-inner-foot-side-stepping portion 4 are located on the innermost foot side, the first-outer-foot-side-stepping portion 3 and the second-outer-foot-side-stepping portion 5 are located on the outermost foot side, and the center stepping portion 6 is located between the first and second inner-foot-side-stepping portions 2 and 4 and the first and second outer-foot-side-stepping portions 3 and 5.

The first groove 7 separates the first-inner-foot-side-stepping portion 2 and the center stepping portion 6. The first groove 7 is located on the outer foot side of the first-inner-foot-side-stepping portion 2 and on the inner foot side of the center stepping portion 6. That is, the first groove 7 is located between the first-inner-foot-side-stepping portion 2 and the center stepping portion 6. The first groove 7 extends to at least the front end of the first-inner-foot-side-stepping portion 2 in the foot length direction. The first groove 7 extends to at least the rear ends of the first-inner-foot-side-stepping portion 2 and the center stepping portion 6 in the foot length direction.

The second groove 8 separates the second-inner-foot-side-stepping portion 4 and the center stepping portion 6. The second groove 8 is located on the outer foot side of the second-inner-foot-side-stepping portion 4 and on the inner foot side of the center stepping portion 6. That is, the second groove 8 is located between the second-inner-foot-side-stepping portion 4 and the center stepping portion 6. The second groove 8 is located forward of the first groove 7. The second groove 8 extends to at least the front ends of the second-inner-foot-side-stepping portion 4 and the center stepping portion 6 in the foot length direction. The second groove 8 extends to at least the rear end of the second-inner-foot-side-stepping portion 4 in the foot length direction.

The third groove 9 separates the center stepping portion 6 from the first-outer-foot-side-stepping portion 3 and the second-outer-foot-side-stepping portion 5. The third groove 9 is located on the outer foot side of the center stepping portion 6 and on the inner foot side of the first-outer-foot-side-stepping portion 3 and the second-outer-foot-side-stepping portion 5. That is, the third groove 9 is located between the center stepping portion 6 and the first and second outer-foot-side-stepping portions 3 and 5. The third groove 9 extends to at least the front ends of the second-outer-foot-side-stepping portion 5 and the center stepping portion 6 in the foot length direction. The third groove 9 extends to at least the rear ends of the first-outer-foot-side-stepping portion 3 and the center stepping portion 6 in the foot length direction.

The first groove 7 is connected to the second groove 8. The first groove 7 and the second groove 8 are configured as one continuous groove extending in the foot length direction.

The first groove 7 is connected to the third groove 9 at the rear of the center stepping portion 6. The second groove 8 and the third groove 9 are connected to each other substantially at the center of the front foot portion 1FC. The second groove 8 is connected to the third groove 9 at the front of the center stepping portion 6. Accordingly, the first groove 7, the second groove 8, and the third groove 9 are connected in an annular shape. The first groove 7, the second groove 8, and the third groove 9 surround the center stepping portion 6.

The thus-configured first groove 7 and the second groove 8 of the sole 1C constitute a space with which the first-inner-foot-side-stepping portion 2, the second-inner-foot-side-stepping portion 4, and the center stepping portion 6 can be elastically deformed. The first-inner-foot-side-stepping portion 2 and the second-inner-foot-side-stepping portion 4 are elastically deformed toward the first groove 7 and the second groove 8 upon application of a compressive force by the thenar portion and the distal phalanx portion of the thumb of the wearer. In this manner, the first-inner-foot-side-stepping portion 2 and the second-inner-foot-side-stepping portion 4 are separated from the center stepping portion 6, and thus, are elastically deformable independently of each other.

Further, the third groove 9 constitutes a space with which the center stepping portion 6, the first-outer-foot-side-stepping portion 3, and the second-outer-foot-side-stepping portion 5 can be elastically deformed. That is, the center stepping portion 6 is surrounded by the first groove 7, the second groove 8, and the third groove 9. Thus, upon application of a compressive force by the MP joints of the second toe, the third toe, and the fourth toe of the wearer, the center stepping portion 6 is elastically deformed toward the first groove 7, the second groove 8, and the third groove 9. In this manner, the center foot stepping portion 6 is separated from the first-inner-foot-side-stepping portion 2 and the second-inner-foot-side-stepping portion 4, and thus, is elastically deformable independently. Accordingly, it is possible to increase the repulsive force Fr1 of the thenar portion and the repulsive force Fr3 of the MP joints of the second toe, the third toe, and the fourth toe in order to supplement a force with which the wearer moves their foot during a kick.

Fourth Variation

Figure 13:
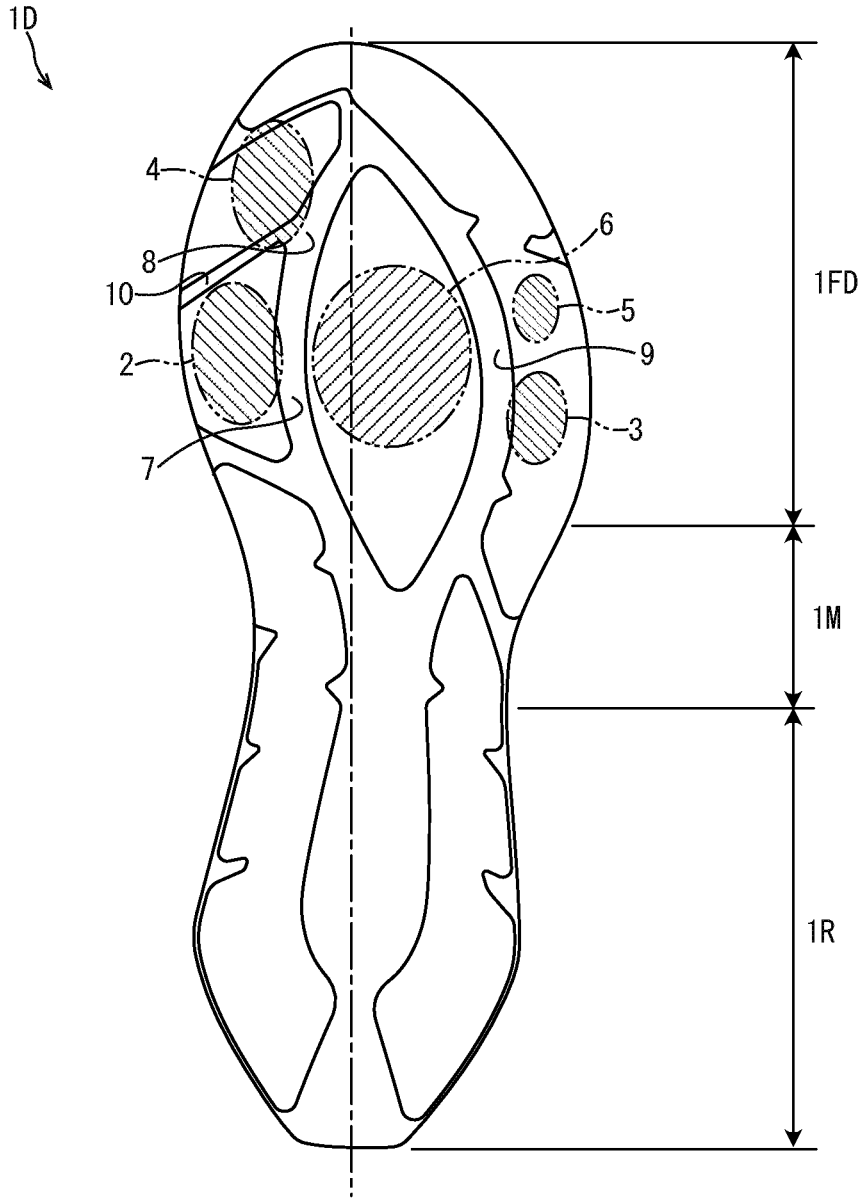
FIG. 13 is a bottom view of a sole according to a fourth variation of the first embodiment of the present teaching.

With reference to FIG. 13, a sole 1D according to a fourth variation will be described. FIG. 13 is a bottom view of the sole 1D according to the fourth variation of the first embodiment of the present teaching. The fourth variation is different from the third variation in further including a fourth groove 10.

As illustrated in FIG. 13, a front foot portion 1FD of the sole 1D includes a first-inner-foot-side-stepping portion 2, a first-outer-foot-side-stepping portion 3, a second-inner-foot-side-stepping portion 4, a second-outer-foot-side-stepping portion 5, a center stepping portion 6, a first groove 7, a second groove 8, a third groove 9, and the fourth groove 10.

The fourth groove 10 separates the first-inner-foot-side-stepping portion 2 and the second-inner-foot-side-stepping portion 4. The fourth groove 10 is located forward of the first-inner-foot-side-stepping portion 2 and rearward of the second-inner-foot-side-stepping portion 4. That is, the fourth groove 10 is located between the first-inner-foot-side-stepping portion 2 and the second-inner-foot-side-stepping portion 4. The fourth groove 10 extends at least from the inner foot end to the outer foot end of the first-inner-foot-side-stepping portion 2 in the foot width direction.

The thus-configured fourth groove 10 of the sole 1D constitutes a space with which the first-inner-foot-side-stepping portion 2 and the second-inner-foot-side-stepping portion 4 can be elastically deformed. The first-inner-foot-side-stepping portion 2 and the second-inner-foot-side-stepping portion 4 are elastically deformed toward the fourth groove 10 upon application of a compressive force by the thenar portion and the distal phalanx portion of the thumb of the wearer. Thus, the first-inner-foot-side-stepping portion 2 and the second-inner-foot-side-stepping portion 4 are elastically deformable independently of each other without hindering elastic deformation in the foot length direction. Accordingly, it is possible to increase the repulsive force Fr2 of the distal phalanx portion of the thumb in order to supplement a force with which the wearer moves their foot during a kick.

Fifth Variation

Figure 14:
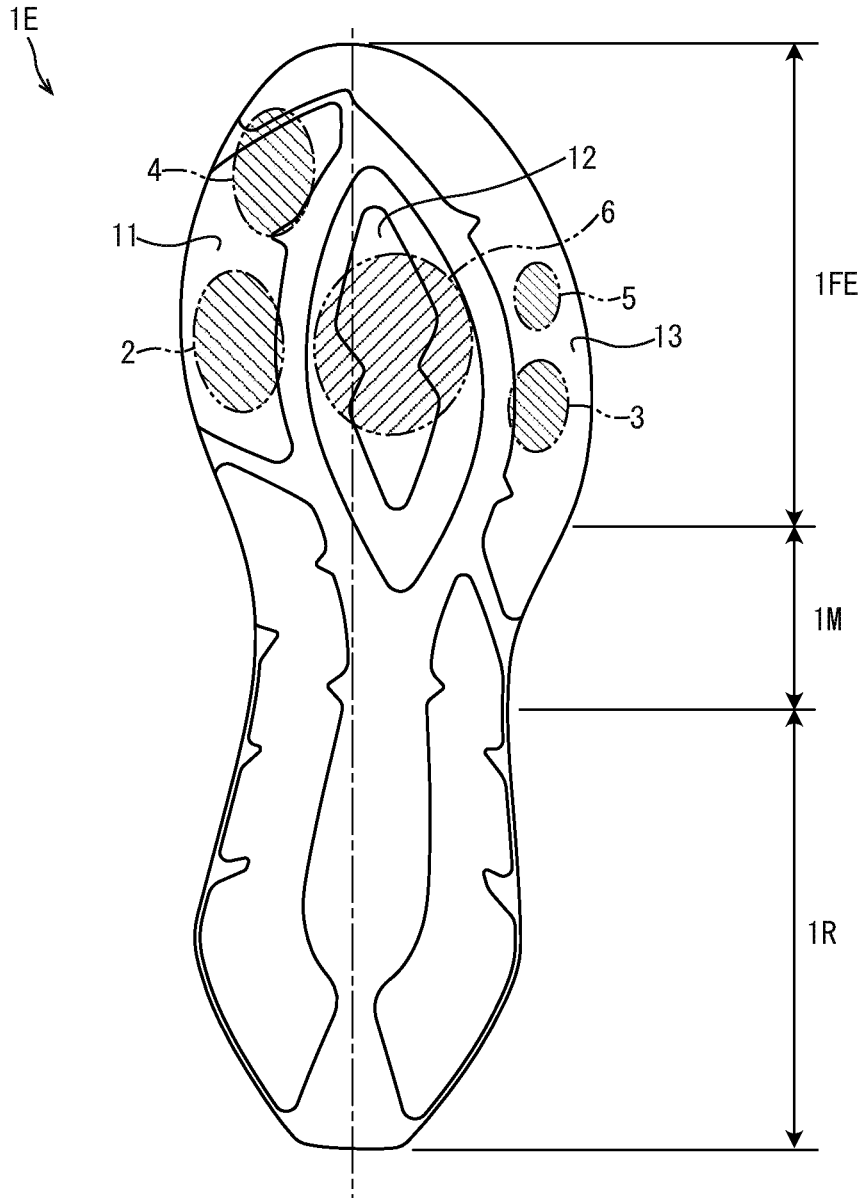
FIG. 14 is a bottom view of a sole according to a fifth variation of the first embodiment of the present teaching.
Figure 15:
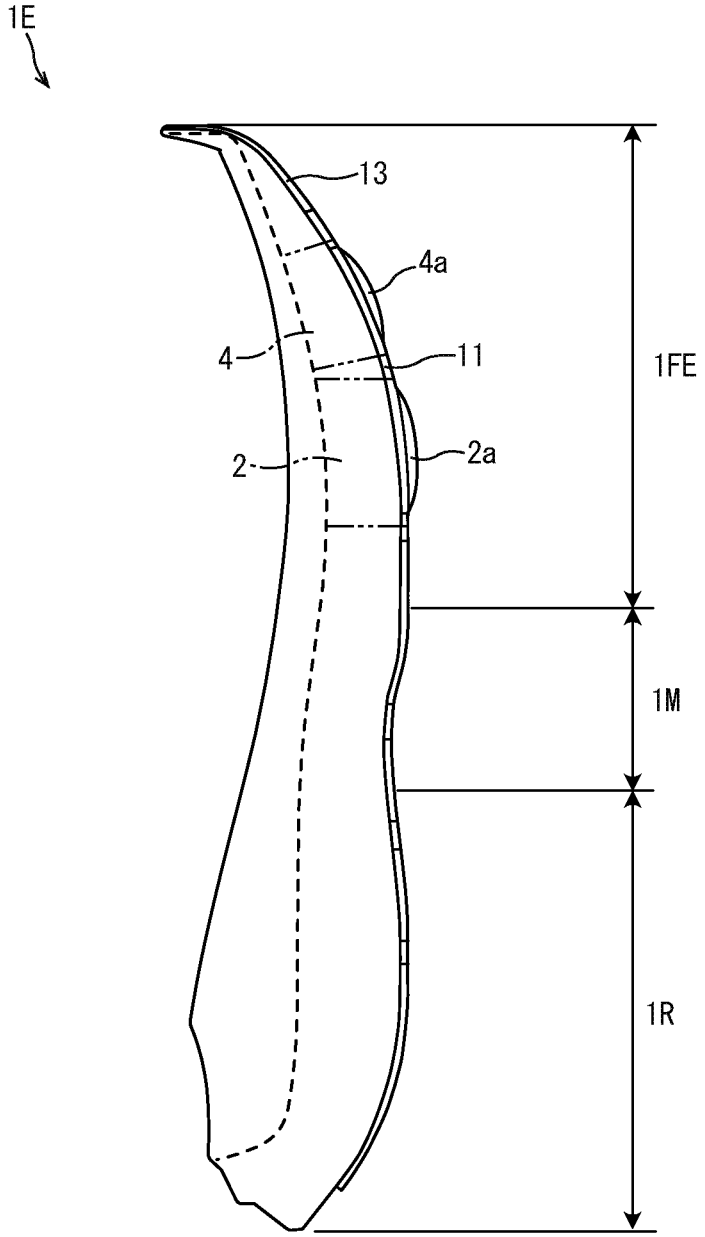
FIG. 15 is a side view of the sole according to the fifth variation of the first embodiment of the present teaching.

With reference to FIGS. 14 and 15, a sole 1E according to a fifth variation will be described. FIG. 14 is a bottom view of the sole 1E according to the fifth variation of the first embodiment of the present teaching. FIG. 15 is a side view of the sole 1E. The fifth variation is different from the third variation in further including an inner-foot-side-stepping-portion outsole 11, a center-stepping-portion outsole 12, and an outer-foot-side-stepping-portion outsole 13.

As illustrated in FIG. 14, a front foot portion 1FE of the sole 1E includes a first-inner-foot-side-stepping portion 2, a first-outer-foot-side-stepping portion 3, a second-inner-foot-side-stepping portion 4, a second-outer-foot-side-stepping portion 5, a center stepping portion 6, a first groove 7, a second groove 8, a third groove 9, the inner-foot-side-stepping-portion outsole 11, the center-stepping-portion outsole 12, and the outer-foot-side-stepping-portion outsole 13.

The front foot portion 1FE is configured as a midsole that protects the foot of the wearer against a shock at landing, unevenness of the ground, and other damages and provides a repulsive force during a kick. The inner-foot-side-stepping-portion outsole 11, the center-stepping-portion outsole 12, and the outer-foot-side-stepping-portion outsole 13 that are outsoles to be in contact with the ground are located below the front foot portion 1FE. The inner-foot-side-stepping-portion outsole 11, the center-stepping-portion outsole 12, and the outer-foot-side-stepping-portion outsole 13 are fixed to the lower surface of the front foot portion 1FE through adhesion by an adhesive, welding, or the like.

Each of the inner-foot-side-stepping-portion outsole 11, the center-stepping-portion outsole 12, and the outer-foot-side-stepping-portion outsole 13 is made of a member with slip resistance and abrasion resistance. Each of the inner-foot-side-stepping-portion outsole 11, the center-stepping-portion outsole 12, and the outer-foot-side-stepping-portion outsole 13 is made of vulcanized rubber, polyvinyl chloride, polyurethane, ethylene vinyl acetate, or other materials.

As illustrated in FIG. 15, the inner-foot-side-stepping-portion outsole 11 reduces abrasion of the inner foot side of the front foot portion 1FE caused by contact with the ground. The inner-foot-side-stepping-portion outsole 11 is located to overlap with at least a part of the first-inner-foot-side-stepping portion 2 when viewed in the top-bottom direction. Thus, the inner-foot-side-stepping-portion outsole 11 covers at least a part of the first-inner-foot-side-stepping portion 2. The inner-foot-side-stepping-portion outsole 11 is curved along the convex surface of the first projection 2*a* of the first-inner-foot-side-stepping portion 2.

The inner-foot-side-stepping-portion outsole 11 is located to overlap with at least a part of the second-inner-foot-side-stepping portion 4 when viewed in the top-bottom direction. Thus, the inner-foot-side-stepping-portion outsole 11 covers at least a part of the second-inner-foot-side-stepping portion 4. The inner-foot-side-stepping-portion outsole 11 is curved along the convex surface of the second projection 4*a* of the second-inner-foot-side-stepping portion 4.

The center-stepping-portion outsole 12 reduces abrasion of a center portion of the front foot portion 1FE caused by contact with the ground. The center-stepping-portion outsole 12 is located to overlap with at least a part of the center stepping portion 6 when viewed in the top-bottom direction. Thus, the center-stepping-portion outsole 12 covers at least a part of the center stepping portion 6. The center-stepping-portion outsole 12 is curved along the convex surface of the center projection 6*a* of the center stepping portion 6.

The outer-foot-side-stepping-portion outsole 13 reduces abrasion of the outer foot side of the front foot portion 1FE caused by contact with the ground. The outer-foot-side-stepping-portion outsole 13 is located to overlap with at least a part of the first-outer-foot-side-stepping portion 3 and the second-outer-foot-side-stepping portion 5 when viewed in the top-bottom direction. Thus, the outer-foot-side-stepping-portion outsole 13 covers at least a part of the first-outer-foot-side-stepping portion 3 and the second-outer-foot-side-stepping portion 5.

The first-inner-foot-side-stepping portion 2 and the second-inner-foot-side-stepping portion 4 of the front foot portion 1FE configured as midsoles are covered with the inner-foot-side-stepping-portion outsole 11, and thus, reduce abrasion caused by contact with the ground. Thus, the first-inner-foot-side-stepping portion 2 and the second-inner-foot-side-stepping portion 4 can maintain repulsive forces. Accordingly, a repulsive force by an elastic force can be effectively obtained in the thenar portion of the wearer during a kick.

The inner-foot-side-stepping-portion outsole 11 is separated from another outsole located forward of the inner-foot-side-stepping-portion outsole 11 and another outsole located rearward of the inner-foot-side-stepping-portion outsole 11. In addition, the inner-foot-side-stepping-portion outsole 11 and the center-stepping-portion outsole 12 are separated by the first groove 7 and the second groove 8. The center-stepping-portion outsole 12 and the outer-foot-side-stepping-portion outsole 13 are separated by the third groove 9.

Thus, the first-inner-foot-side-stepping portion 2, the second-inner-foot-side-stepping portion 4, and the center stepping portion 6 can be elastically deformable independently of each other without inhibition of elastic deformation by, for example, the inner-foot-side-stepping-portion outsole 11, the center-stepping-portion outsole 12, and the outer-foot-side-stepping-portion outsole 13 surrounding these portions. Accordingly, the repulsive force supplementing a force with which the wearer moves their foot during a kick can be increased in the thenar portion and the distal phalanx portion of the thumb.

Second Embodiment

Figure 16:
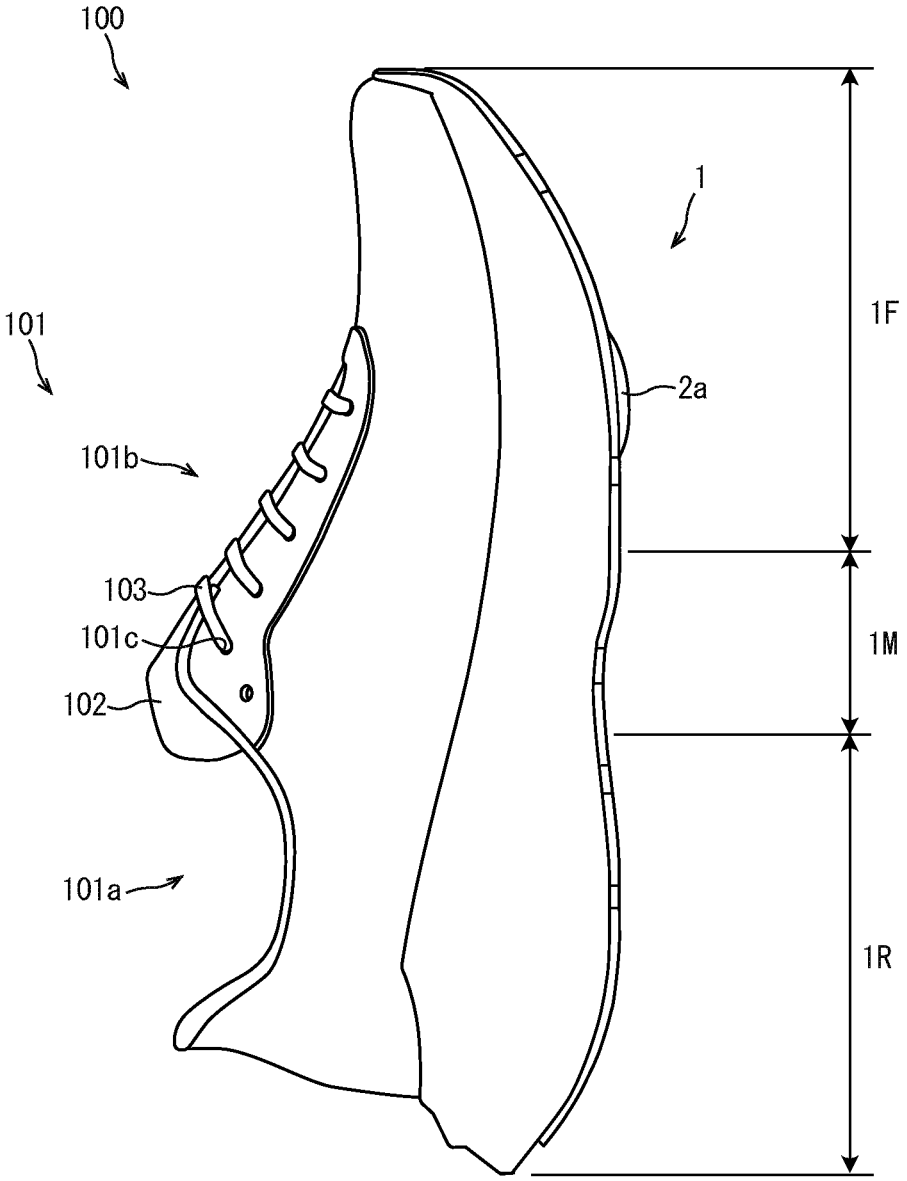
FIG. 16 is a side view of a shoe according to a second embodiment of the present teaching.

With reference to FIG. 16, a shoe 100 including a sole 1 according to a second embodiment will be described. FIG. 16 is a side view of the shoe 100 according to the second embodiment of the present teaching. The drawings used in the following embodiment and variations shows a shoe 100 for the left foot unless otherwise specified, but description is also similarly applicable to a shoe for the right foot.

<Overall Configuration of Shoe>

As illustrated in FIG. 16, the shoe 100 is, for example, a running shoe. The shoe 100 assists a kick of a wearer of the shoe 100 by a repulsive force of the sole 1 against the thenar portion of the wearer. The shoe 100 includes the sole 1, an upper 101, and a string 103.

The sole 1 includes a first-inner-foot-side-stepping portion 2. The first-inner-foot-side-stepping portion 2 is located on the lower surface of the sole 1. The sole 1 is shaped in conformity with the shape of the foot of the wearer.

The upper 101 is a member covering the foot of the wearer. The upper 101 is located above the sole 1. The upper 101 protects the foot of the wearer of the shoe 100 against changes in external weather conditions and obstacles, and others. The upper 101 keeps the position of the foot of the wearer with respect to the sole 1. The upper 101 is made of a member with air permeability, stretchability, and flexibility. The upper 101 is made of, for example, natural leather, synthetic leather, a chemical fiber mesh material, canvas, or a TPU film. The upper 101 is fixed to the upper surface of the sole 1 by adhesion, sewing, or other techniques.

In a front foot portion 1F of the sole 1, the upper 101 extends upward from the outer edge of the sole 1 and covers the upper surface of the sole 1. In an intermediate foot portion 1M and a rear foot portion 1R of the sole 1, the upper 101 constitutes a side portion extending upward from the outer edge of the sole 1. Thus, in the intermediate foot portion 1M and the rear foot portion 1R of the sole 1, the upper 101 does not cover the upper surface of the sole 1 but surrounds the sole 1 along the outer edge of the sole 1. That is, upper portions of the intermediate foot portion 1M and the rear foot portion 1R of the upper 101 are open.

The rear foot portion 1R of the upper 101 has a shoe opening 101*a* through which the foot of the wearer of the shoe 100 is inserted between the sole 1 and the upper 101. The shoe opening 101*a* is open upward from the rear end of the rear foot portion 1R of the upper 101 to the front end of the rear foot portion 1R. That is, the shoe opening 101*a* is located above the heel portion of the sole 1. The intermediate foot portion 1M of the upper 101 has an opening 101*b* for adjusting the foot width of the upper 101 to fit the foot of the wearer. The opening 101*b* is open upward from the front end of the shoe opening 101*a* to the front end of the intermediate foot portion 1M toward the front of the upper 101.

A tongue 102 protects the instep of the wearer and prevents foreign substance from entering the inside of the shoe 100 from the outside. The tongue 102 is located at the opening 101*b* and covers the opening 101*b* from the inner side of the upper 101. The tongue 102 is made of a cushioning material such as a sponge covered with a textile fabric. The front end of the tongue 102 is fixed to the back surface of the upper 101 at a position forward of the opening 101*b*. The tongue 102 is rotatable forward within a range not projecting outward from the inner side of the upper 101 when the wearer puts on and takes off the shoe 100.

The string 103 is a member that closes the opening 101*b* of the upper 101. The string 103 alternately passes through a plurality of string holes 101*c* formed in the left and right end potions of the opening 101*b*. The string 103 adjusts the distance between the left and right end portions of the opening 101*b* such that the upper 101 closely fits the shape of the foot of the wearer.

In the thus-configured shoe 100, the sole 1 and the upper 101 can follow movement of the foot of the wearer by adjusting the opening 101*b* of the upper 101 with the string 103 in conformity with the foot of the wearer. The shoe 100 supports the thenar portion of the wearer with a repulsive force of the first-inner-foot-side-stepping portion 2. The repulsive force of the first-inner-foot-side-stepping portion 2 including the first projection 2*a* is larger than those in portions of the front foot portion 1F other than the first-inner-foot-side-stepping portion 2. Accordingly, the repulsive force supplementing a force with which the wearer moves their foot during a kick can be increased in the thenar portion and the distal phalanx portion of the thumb.

In a case where the wearer moves a pressure applied to the thenar portion in the forward direction in order to move forward by walking, the shoe 100 pushes the thenar portion of the wearer in the upward direction with the repulsive force of the first-inner-foot-side-stepping portion 2. The shoe 100 assists weight movement from the thenar portion to the distal phalanx portion of the thumb of the wearer with the repulsive force of the first-inner-foot-side-stepping portion 2 to thereby smooth forward movement of the foot of the wearer. Accordingly, the shoe 100 can effectively obtain a repulsive force by an elastic force in the thenar portion of the wearer during a kick.

Other Variations

The embodiments and variations of the present teaching have been described above, but the embodiments and the variations are merely examples for carrying out the present teaching. Thus, the present teaching is not limited to the embodiments and the variations, and the embodiments and the variations may be modified as necessary within a range not departing from the gist of the teaching.

In the first embodiment, it is sufficient that the sole 1 includes at least one of the midsole or the outsole.

In the first embodiment, the front foot portion 1F includes the first-inner-foot-side-stepping portion 2. Alternatively, the front foot portion may include a first-inner-foot-side-stepping portion and a first groove, for example. The front foot portion may include a first-inner-foot-side-stepping portion, a second-inner-foot-side-stepping portion, a first groove, and a second groove, for example. The front foot portion may include a first-inner-foot-side-stepping portion, a second-inner-foot-side-stepping portion, and a center stepping portion, for example. The front foot portion may include a first-inner-foot-side-stepping portion, a center stepping portion, and a first groove, for example. In this manner, it is sufficient that the front foot portion may include any combination of a stepping portion and a groove in addition to the first-inner-foot-side-stepping portion.

In the first embodiment, the front foot portion 1F includes the first-inner-foot-side-stepping portion 2 including at least a part of a range overlapping with the thenar portion of the wearer when viewed in the top-bottom direction. Alternatively, the first-inner-foot-side-stepping portion may include a range overlapping with at least a part of a range overlapping with the thenar portion of the wearer and at least a part of a range overlapping with the distal phalanx portion of the thumb, when viewed in the top-bottom direction.

In the first embodiment, the first variation, and the second variation, the first projection 2*a* is located to overlap with the range A2 overlapping with the thenar portion of the wearer, for example, when viewed in the top-bottom direction. However, it is sufficient that the first projection is located to at least partially overlap with a range overlapping with the thenar portion of the wearer, when viewed in the top-bottom direction. The first projection is preferably located to be included in the range overlapping with the thenar portion of the wearer. The first projection is preferably located to include the range overlapping with the thenar portion of the wearer.

In the first variation, the second projection 4*a* is located to overlap with the range A4 overlapping with the distal phalanx portion of the thumb of the wearer, for example, when viewed in the top-bottom direction. However, it is sufficient that the second projection is located to at least partially overlap with a range overlapping with the distal phalanx portion of the thumb of the wearer, when viewed in the top-bottom direction. The second projection is preferably located to be included in the range overlapping with the distal phalanx portion of the thumb of the wearer. The second projection is preferably located to include the range overlapping with the distal phalanx portion of the thumb of the wearer.

In the second variation, the center projection 6*a* is located to overlap with the range A6 overlapping with the MP joints of the second toe, the third toe, and the fourth toe of the wearer, for example, when viewed in the top-bottom direction. However, it is sufficient that the center projection is located to at least partially overlap with the range overlapping with the MP joints of the second toe, the third toe, and the fourth toe of the wearer, when viewed in the top-bottom direction. The center projection is preferably located to be included in the range overlapping with the MP joints of the second toe, the third toe, and the fourth toe of the wearer. The center projection is preferably located to include the range overlapping with the MP joints of the second toe, the third toe, and the fourth toe of the wearer.

In the first embodiment, the first variation, and the second variation, each of the first-inner-foot-side-stepping portion 2, the second-inner-foot-side-stepping portion 4, and the center stepping portion 6 has the convex surface curved and projecting downward. However, it is sufficient that each of the first-inner-foot-side-stepping portion, the second-inner-foot-side-stepping portion, and the center stepping portion has a shape projecting downward.

In the first embodiment, the front foot portion 1F as a midsole is composed of the elastic body. Alternatively, the front foot portion may be composed of a foamed body. The front foot portion may be made of a material as a foamed body obtained by foam molding a material including at least one of a resin component such as ethylene vinyl acetate, polyurethane, and foam rubber or a rubber component.

The front foot portion composed of a foamed body is configured as a midsole or a sole in which a midsole and an outsole are integrated. When the sole including the first-inner-foot-side-stepping portion is composed of a foamed body, a repulsive force supplementing a force with which the wearer moves their foot during a kick can be increased in the thenar portion.

In the fifth variation, the front foot portion 1FE as a midsole includes the inner-foot-side-stepping-portion outsole 11 covering the first-inner-foot-side-stepping portion 2 and the second-inner-foot-side-stepping portion 4. Alternatively, the first-inner-foot-side-stepping portion and the second-inner-foot-side-stepping portion may be covered with different inner-foot-side-stepping-portion outsoles. The inner-foot-side-stepping-portion outsole may cover at least a part of the first-inner-foot-side-stepping portion and the second-inner-foot-side-stepping portion.

In the fifth variation, the inner-foot-side-stepping-portion outsole 11, the center-stepping-portion outsole 12, and the outer-foot-side-stepping-portion outsole 13 are separated by the first groove 7, the second groove 8, and the third groove 9. Alternatively, the inner-foot-side-stepping-portion outsole and the center-stepping-portion outsole may be integrated, the center-stepping-portion outsole and the outer-foot-side-stepping-portion outsole may be integrated, or the inner-foot-side-stepping-portion outsole, the center-stepping-portion outsole, and the outer-foot-side-stepping-portion outsole may be integrated.

Each of the variations described above provides functions and effects similar to those of the embodiments described above.

Optional combinations of the embodiments and the variations described above may also be useful as additional embodiments of the present teaching. Such an additional embodiment made by combination has the advantages of each of the combined embodiments and variations.

Features disclosed herein include the following:

(1) A sole for a shoe composed of an elastic body. The sole includes a front foot portion that is a range including at least a range from a front end to a thenar portion and a hypothenar portion of a wearer wearing the shoe. The front foot portion includes a first-inner-foot-side-stepping portion that is a range overlapping with a placement portion on which a foot of the wearer is placed, the first-inner-foot-side-stepping portion including at least a range overlapping with the thenar portion of the wearer, when viewed in a top-bottom direction, and a first-outer-foot-side-stepping portion that is a range overlapping with the placement portion, the first-outer-foot-side-stepping portion including at least a part of a range overlapping with the hypothenar portion of the wearer, when viewed in the top-bottom direction. The first-inner-foot-side-stepping portion is at least partially curved and projects in a downward direction, and is thicker than the first-outer-foot-side-stepping portion on an imaginary line passing through the thenar portion and the hypothenar portion of the wearer.

(2) The sole described in (1) in which the front foot portion further includes a second-inner-foot-side-stepping portion that is a range overlapping with the placement portion, the second-inner-foot-side-stepping portion including at least a part of a range overlapping with a distal phalanx portion of a thumb of the wearer, when viewed in the top-bottom direction, and a second-outer-foot-side-stepping portion that is a range overlapping with the placement portion, the second-outer-foot-side-stepping portion including at least a part of a range overlapping with a distal phalanx portion of a little finger of the wearer, when viewed in the top-bottom direction. The second-inner-foot-side-stepping portion is at least partially curved and projects in the downward direction, and is thicker than the second-outer-foot-side-stepping portion on an imaginary line connecting the distal phalanx portion of the thumb and the distal phalanx portion of the little finger of the wearer.

(3) The sole described in (1) or (2) in which the first-inner-foot-side-stepping portion includes a projection having a curved surface that is curved in a foot length direction and in a foot width direction.

(4) The sole described in (2) in which the second-inner-foot-side-stepping portion includes a projection having a curved surface that is curved in a foot length direction and in a foot width direction.

(5) The sole described in any one of (1) to (4) in which the front foot portion further includes a center stepping portion located on an outer foot side of the first-inner-foot-side-stepping portion and on an inner foot side of the first-outer-foot-side-stepping portion, when viewed in the top-bottom direction. The center stepping portion is at least partially curved and projects in the downward direction, and is thicker than the first-outer-foot-side-stepping portion on the imaginary line connecting the thenar and the hypothenar of the wearer.

(6) The sole described in any one of (1) to (5) in which the front foot portion is a midsole, and an outsole is located below the midsole.

(7) The sole described in (6) in which the outsole includes an inner-foot-side-stepping-portion outsole overlapping with at least a part of the first-inner-foot-side-stepping portion when viewed in the top-bottom direction.

(8) The sole described in (7) in which the inner-foot-side-stepping-portion outsole is separated from an outsole located rearward of the inner-foot-side-stepping-portion outsole and on an outer foot side of the inner-foot-side-stepping-portion outsole.

(9) The sole described in (8) in which the inner-foot-side-stepping-portion outsole overlaps at least a part of the second-inner-foot-side-stepping portion when viewed in the top-bottom direction.

(10) The sole described in any one of (1) to (9) in which the front foot portion is composed of a foamed body.

(11) The sole described in (5) in which a first groove extending in a foot length direction is located on an outer foot side of the first-inner-foot-side-stepping portion and on an inner foot side of the center stepping portion.

(12) The sole described in (11) in which a second groove extending in the foot length direction is located on an outer foot side of the second-inner-foot-side-stepping portion and on the inner foot side of the center stepping portion.

(13) The sole described in (11) in which a third groove extending in the foot length direction is located on an outer foot side of the center stepping portion and on an inner foot side of the first-outer-foot-side-stepping portion.

(14) The sole described in (2) in which a fourth groove extending in a foot width direction is located forward of the first-inner-foot-side-stepping portion and rearward of the second-inner-foot-side-stepping portion.

(15) The sole described in (12) in which the first groove and the second groove are connected to each other.

(16) The sole described in (13) in which the first groove and the third groove are connected to each other.

(17) A shoe comprising: the sole described in (1); and an upper covering the sole.

INDUSTRIAL APPLICABILITY

The present teaching is applicable for running shoes.

What is claimed is:

1. A sole for a shoe, the sole being composed of an elastic body, wherein the sole includes a front foot portion extending in at least a range from a front end to a thenar portion and a hypothenar portion of a wearer wearing the shoe, the front foot portion includes a first-inner-foot-side-stepping portion extending in a range overlapping with a placement portion on which a foot of the wearer is placed, the first-inner-foot-side-stepping portion extending in at least a part of a range overlapping with the thenar portion of the wearer, when viewed in a top-bottom direction, and a first-outer-foot-side-stepping portion that overlaps with the placement portion, the first-outer-foot-side-stepping portion extending in at least a part of a range overlapping with the hypothenar portion of the wearer, when viewed in the top-bottom direction, the first-inner-foot-side-stepping portion is at least partially curved and projects in a downward direction from an upper surface of the front foot portion to a lower surface of the front foot portion, such that the first-inner-foot-side-stepping portion is thicker than the first-outer-foot-side-stepping portion in the downward direction on an imaginary line passing through the thenar portion and the hypothenar portion of the wearer, and the first-inner-foot-side-stepping portion includes a projection having a curved surface extending convexly in the downward direction, the projection being curved in a foot length direction and in a foot width direction such that a thickness of the first-inner-foot-side-stepping portion from the upper surface to the lower surface of the front foot portion increases toward an apex of the projection.

2. The sole according to claim 1, wherein the front foot portion further includes a second-inner-foot-side-stepping portion extending in a range overlapping with the placement portion, the second-inner-foot-side-stepping portion extending in at least a part of a range overlapping with a distal phalanx portion of a thumb of the wearer, when viewed in the top-bottom direction, and a second-outer-foot-side-stepping portion extending in a range overlapping with the placement portion, the second-outer-foot-side-stepping portion extending in at least a part of a range overlapping with a distal phalanx portion of a little finger of the wearer, when viewed in the top-bottom direction, and the second-inner-foot-side-stepping portion is at least partially curved and projects in the downward direction, and is thicker than the second-outer-foot-side-stepping portion on an imaginary line connecting the distal phalanx portion of the thumb and the distal phalanx portion of the little finger of the wearer.

3. The sole according to claim 2, wherein the second-inner-foot-side-stepping portion includes a projection having a curved surface that is curved in a foot length direction and in a foot width direction.

4. The sole according to claim 2, wherein a fourth groove extending in a foot width direction is located forward of the first-inner-foot-side-stepping portion and rearward of the second-inner-foot-side-stepping portion.

5. The sole according to claim 1, wherein the front foot portion further includes a center stepping portion located on an outer foot side of the first-inner-foot-side-stepping portion and on an inner foot side of the first-outer-foot-side-stepping portion, when viewed in the top-bottom direction, and the center stepping portion is at least partially curved and projects in the downward direction, and is thicker than the first-outer-foot-side-stepping portion on the imaginary line connecting the thenar and the hypothenar of the wearer.

6. The sole according to claim 5, wherein a first groove extending in a foot length direction is located on an outer foot side of the first-inner-foot-side-stepping portion and on an inner foot side of the center stepping portion.

7. The sole according to claim 6, wherein a second groove extending in the foot length direction is located on an outer foot side of a second-inner-foot-side-stepping portion extending in a range overlapping with the placement portion, the second-inner-foot-side-stepping portion extending in at least a part of a range overlapping with a distal phalanx portion of a thumb of the wearer, when viewed in the top-bottom direction and on the inner foot side of the center stepping portion.

8. The sole according to claim 7, wherein the first groove and the second groove are connected to each other.

9. The sole according to claim 6, wherein a third groove extending in the foot length direction is located on an outer foot side of the center stepping portion and on an inner foot side of the first-outer-foot-side-stepping portion.

10. The sole according to claim 9, wherein the first groove and the third groove are connected to each other.

11. The sole according to claim 1, wherein the front foot portion is a midsole, and an outsole is located below the midsole.

12. The sole according to claim 11, wherein the outsole includes an inner-foot-side-stepping-portion outsole overlapping with at least a part of the first-inner-foot-side-stepping portion when viewed in the top-bottom direction.

13. The sole according to claim 12, wherein the inner-foot-side-stepping-portion outsole is separated from an outsole located rearward of the inner-foot-side-stepping-portion outsole and on an outer foot side of the inner-foot-side-stepping-portion outsole.

14. The sole according to claim 13, wherein the inner-foot-side-stepping-portion outsole overlaps at least a part of a second-inner-foot-side-stepping portion that is a range overlapping with the placement portion, the second-inner-foot-side-stepping portion including at least a part of a range overlapping with a distal phalanx portion of a thumb of the wearer, when viewed in the top-bottom direction.

15. The sole according to claim 1, wherein the front foot portion is composed of a foamed body.

16. A shoe comprising:

the sole according to claim 1; and an upper covering the sole.

* * * * *